US010472039B2

(12) United States Patent
McGinley et al.

(10) Patent No.: US 10,472,039 B2
(45) Date of Patent: Nov. 12, 2019

(54) HYDRAULIC STEERING SYSTEM FOR A WATERCRAFT

(71) Applicant: BRP US INC., Sturtevant, WI (US)

(72) Inventors: Samuel McGinley, Milwaukee, WI (US); Benjamin Jones, Saint Francis, WI (US); Darrell Wiatrowski, Libertyville, IL (US)

(73) Assignee: BRP US INC., Sturtevant, WI (US)

( * ) Notice: Subject to any disclaimer, the term of this patent is extended or adjusted under 35 U.S.C. 154(b) by 189 days.

(21) Appl. No.: 15/799,468

(22) Filed: Oct. 31, 2017

(65) Prior Publication Data

US 2019/0118922 A1 Apr. 25, 2019

Related U.S. Application Data

(63) Continuation-in-part of application No. 15/583,533, filed on May 1, 2017, now abandoned.

(60) Provisional application No. 62/415,007, filed on Oct. 31, 2016, provisional application No. 62/329,815, filed on Apr. 29, 2016.

(51) Int. Cl.

| | |
|---|---|
| ***B63H 25/00*** | (2006.01) |
| ***B63H 25/14*** | (2006.01) |
| ***B63H 25/02*** | (2006.01) |
| ***B63H 20/12*** | (2006.01) |
| *B63H 20/00* | (2006.01) |

(52) U.S. Cl.

CPC ..... *B63H 25/14* (2013.01); *B63H 20/12* (2013.01); *B63H 25/02* (2013.01); *B63H 2020/003* (2013.01)

(58) Field of Classification Search

USPC ..... 70/21

See application file for complete search history.

(56) References Cited

U.S. PATENT DOCUMENTS

| | | | |
|---|---|---|---|
| 4,220,111 | A | 9/1980 | Krautkremer et al. |
| 4,691,659 | A | 9/1987 | Ito et al. |
| 6,230,642 | B1 | 5/2001 | McKenney et al. |

(Continued)

OTHER PUBLICATIONS

SeaStar Solutions, Liquid Tiebar Valve for SeaStar Steering Systems Installation Instructions and Owner's Manual, 1998, Marine Canada Acquisition Inc., DBA SeaStar Solutions, Canada.

*Primary Examiner* — James M McPherson
(74) *Attorney, Agent, or Firm* — BCF LLP

(57) ABSTRACT

A hydraulic steering system for a watercraft has first and second hydraulic steering actuators for steering first and second outdrives respectively, at least one hydraulic pump selectively supplying hydraulic pressure to at least one of the first and second actuators, a steering controller operatively connected to the at least one pump, a hydraulic helm selectively supplying hydraulic pressure to the first and second actuators, an auxiliary steering input device connected to the controller, and at least one mode selection valve having first and second mode positions for steering the watercraft in first and second steering modes respectively. In the first steering mode, the hydraulic helm is hydraulically connected to the first and second actuators. In the second steering mode, the hydraulic helm is hydraulically disconnected from the first and second actuators. A watercraft having the steering system and a method for steering a watercraft are also disclosed.

24 Claims, 13 Drawing Sheets

(56) References Cited

U.S. PATENT DOCUMENTS

| | | | | |
|---|---|---|---|---|
| 6,234,853 | B1 | 5/2001 | Lanyi et al. | |
| 6,386,930 | B2 | 5/2002 | Moffet | |
| 6,865,996 | B2 | 3/2005 | Borrett | |
| 6,978,729 | B2 | 12/2005 | Bertetti et al. | |
| 6,994,046 | B2 | 2/2006 | Kaji et al. | |
| RE39,032 | E | 3/2006 | Gonring et al. | |
| 7,037,150 | B2 | 5/2006 | Morvillo | |
| 7,137,347 | B2 | 11/2006 | Wong et al. | |
| 7,267,068 | B2 | 9/2007 | Bradley et al. | |
| 7,305,928 | B2 | 12/2007 | Bradley et al. | |
| 7,416,458 | B2 | 8/2008 | Suemori et al. | |
| 7,467,595 | B1 | 12/2008 | Lanyi et al. | |
| 7,524,219 | B2 | 4/2009 | Torrangs et al. | |
| 7,727,036 | B1 | 6/2010 | Poorman et al. | |
| 7,883,383 | B2 | 2/2011 | Larsson | |
| 8,019,498 | B2 | 9/2011 | Yamazaki et al. | |
| 8,060,265 | B2 | 11/2011 | Hallenstvedt et al. | |
| 8,131,412 | B2 | 3/2012 | Larsson et al. | |
| 8,190,316 | B2 | 5/2012 | Kaji | |
| 8,417,399 | B2 | 4/2013 | Arbuckle et al. | |
| 8,478,464 | B2 | 7/2013 | Arbuckle et al. | |
| 8,700,238 | B2 | 4/2014 | Hiramatsu | |
| 8,862,293 | B2 | 10/2014 | Hara et al. | |
| 9,132,903 | B1 | 9/2015 | Gable et al. | |
| 9,162,744 | B2 | 10/2015 | Hitachi et al. | |
| 2003/0033969 | A1* | 2/2003 | Doetsch | B63H 25/12 114/150 |
| 2005/0181687 | A1* | 8/2005 | Okumura | B63H 20/12 440/53 |
| 2011/0028057 | A1 | 2/2011 | Torraangs et al. | |
| 2011/0172858 | A1 | 7/2011 | Gustin et al. | |
| 2012/0143408 | A1* | 6/2012 | Hosokawa | B63H 25/04 701/21 |
| 2014/0174331 | A1 | 6/2014 | Hitachi et al. | |
| 2015/0034001 | A1* | 2/2015 | Clarke | B63H 25/24 114/144 R |
| 2015/0246716 | A1 | 9/2015 | Skauen | |
| 2015/0266557 | A1 | 9/2015 | Morikami et al. | |
| 2016/0090167 | A1* | 3/2016 | Gai | B63H 25/02 74/471 R |
| 2016/0375975 | A1* | 12/2016 | Fell | B63H 21/21 440/1 |

* cited by examiner

HYDRAULIC STEERING SYSTEM FOR A WATERCRAFT

CROSS-REFERENCE

The present application claims priority to U.S. Provisional Patent Application No. 62/415,007, filed Oct. 31, 2016, and is a continuation-in-part of U.S. patent application Ser. No. 15/583,533, filed May 1, 2017, which claims priority to U.S. Provisional Patent Application No. 62/329,815, filed Apr. 29, 2016, the entirety of all of which is incorporated herein by reference.

FIELD OF TECHNOLOGY

The present technology relates to hydraulic steering systems for watercraft.

BACKGROUND

Many watercraft are propelled by outdrives such as outboard engines, stern drives and pod drives for example. To steer the watercraft, the outdrives are pivoted relative to the rest of the watercraft. This is often achieved by hydraulic steering actuators. To control the steering of the watercraft, the driver turns a helm.

In some hydraulic steering systems, turning the helm pushes hydraulic fluid in one direction to the hydraulic steering actuators which causes them to steer the outdrives. In such systems, the helm acts as a hydraulic pump and is known as a hydraulic helm.

In other hydraulic steering systems, a helm position sensor senses the position of the helm and sends a signal representative of this position to a steering controller. Based at least on this signal, the steering controller sends signals to hydraulic pumps and, in some cases, valves to control the supply of hydraulic fluid to the hydraulic steering actuators in order to achieve the desired steering. These systems are known as steer-by-wire systems.

To facilitate docking maneuvers, some watercraft having a steer-by-wire system are provided with an auxiliary steering input device such as a joystick. To use the joystick, the driver first switches to a docking mode. This can be done by pressing a button or simply in response to movement of the joystick. Other conditions may have to be met prior to switching to the docking mode, such as being at a low watercraft speed for example. Once in the docking mode, the steering controller uses signals received from a joystick position sensor sensing a position of the joystick to control movement of the watercraft. In the docking mode, signals from the helm position sensor are not used. As such turning the helm when in the docking mode has no effect on the steering of the watercraft. Based on the signal received from the joystick, the steering controller sends signals to hydraulic pumps and valves to control the supply of hydraulic fluid to the hydraulic steering actuators in order to achieve the desired movement of the watercraft. In the docking mode, the position of the joystick also determines the thrust generated by each outdrive. In the docking mode, when two outdrives are provided, the two outdrives can be steered in opposite directions and can also generate thrust in opposite directions. As such, in the docking mode, the watercraft can translate in any direction, can be steered in a motion similar to the one that occurs when the helm is used, and can pivot about itself. As would be understood, these maneuvers make docking of the watercraft easier.

In a watercraft having a steering-by-wire system, providing a joystick to operate the watercraft in a docking mode is relatively simple. A suitable steering controller is provided which uses the signals from the helm position sensor or the joystick position sensor to control the watercraft depending on the selected steering mode.

As would be understood, it would be advantageous to provide an auxiliary steering device and provide a docking mode on watercraft having a hydraulic helm. However, simply adding a joystick and suitable controller to such a watercraft does not provide a functional auxiliary steering device with a docking mode, since turning the helm results in steering of the outdrives.

There is therefore a desire for a watercraft having a hydraulic helm and an auxiliary steering device to provide a docking mode.

Also, should the steering system cease operation when in the docking mode, it is possible that the outdrives could remain in a splayed configuration. In such situations, conventional steer-by-wire systems require that the operator disengages one or both outdrives from the steering system and then manually pushing one or both outdrives until they are properly aligned. As will be appreciated, this is inconvenient.

Outdrives can also become misaligned over time, which would require a similar solution to be used.

There is therefore a desire for a watercraft having a steering system that facilitates the realignment of the outdrives should they become misaligned.

SUMMARY

It is an object of the present technology to ameliorate at least some of the inconveniences present in the prior art.

According to one aspect of the present technology, there is provided a watercraft having a hull, a first outdrive operatively connected to the hull, a first hydraulic steering actuator operatively connected to the first outdrive for steering the first outdrive, a second outdrive operatively connected to the hull, a second hydraulic steering actuator operatively connected to the second outdrive for steering the second outdrive, at least one hydraulic pump selectively supplying hydraulic pressure to at least one of the first and second hydraulic steering actuators, a steering controller operatively connected to the at least one hydraulic pump for controlling the at least one hydraulic pump, a hydraulic helm selectively supplying hydraulic pressure to the first and second hydraulic steering actuators, an auxiliary steering input device connected to the steering controller for sending steering signals to the steering controller, and at least one mode selection valve having a first mode position for steering the watercraft in a first steering mode and a second mode position for steering the watercraft in a second steering mode. In the first steering mode, the at least one mode selection valve is in the first mode position for hydraulically connecting the hydraulic helm to the first and second hydraulic steering actuators, the hydraulic helm is a steering input of the watercraft, and hydraulic pressure is supplied to the first and second hydraulic steering actuators by the hydraulic helm. In the second steering mode, the at least one mode selection valve is in the second mode position for hydraulically disconnecting the hydraulic helm from the first and second hydraulic steering actuators, the auxiliary steering input device is the steering input of the watercraft, and hydraulic pressure is supplied to at least one of the first and second hydraulic steering actuators by the at least one hydraulic pump.

In some implementations of the present technology, in the first steering mode the at least one mode selection valve hydraulically connects the first hydraulic steering actuator to the second hydraulic steering actuator such that turning the hydraulic helm in a first direction causes hydraulic pressure to flow from the hydraulic helm to the first hydraulic steering actuator, from the first steering actuator to the second hydraulic actuator, and from the second hydraulic actuator to the hydraulic helm.

In some implementations of the present technology, the at least one hydraulic pump is a first hydraulic pump supplying hydraulic pressure to the first hydraulic steering actuator. A second hydraulic pump supplies hydraulic pressure to the second hydraulic steering actuator. In the second steering mode the first and second hydraulic steering actuators are hydraulically disconnected from each other, the first hydraulic pump and the first hydraulic steering actuator form a first hydraulic circuit, the second hydraulic pump and the second hydraulic steering actuator form a second hydraulic circuit, and the first and second hydraulic circuits are hydraulically separate from each other.

In some implementations of the present technology, in the second steering mode the at least one mode selection valve hydraulically disconnects the first hydraulic steering actuator from the second hydraulic steering actuator.

In some implementations of the present technology, a mode selector is connected to the steering controller. The steering controller controls a position of the at least one mode selection valve in response to signals received from the mode selector.

In some implementations of the present technology, the at least one mode selection valve is a first mode selection valve selectively hydraulically connecting the hydraulic helm to the first steering actuator. A second mode selection valve selectively hydraulically connects the hydraulic helm to the second steering actuator.

In some implementations of the present technology, in the first steering mode, the first and second hydraulic steering actuators steer the first and second outdrives together in a same direction. In the second steering mode, the first and second hydraulic steering actuators steer the first and second outdrives independently from each other.

In some implementations of the present technology, a pump valve selectively hydraulically connects the at least one hydraulic pump to the at least one of the first and second hydraulic steering actuators. The pump valve hydraulically connects the at least one hydraulic pump to the at least one of the first and second hydraulic steering actuators at least in the second steering mode.

In some implementations of the present technology, a first direction valve is hydraulically connected to the first hydraulic steering actuator for controlling a direction of hydraulic pressure supply to the first hydraulic steering actuator. A second direction valve hydraulically connected to the second hydraulic steering actuator for controlling a direction of hydraulic pressure supply to the second hydraulic steering actuator.

In some implementations of the present technology, the first and second direction valves are connected to the steering controller. The steering controller controls positions of the first and second direction valves. In the first steering mode, the first and second direction valves remain in a same position regardless of a direction of turning of the hydraulic helm. In the second steering mode, the steering controller controls positions of the first and second direction valves based on a position of the auxiliary steering device.

In some implementations of the present technology, a helm pressure sensor senses a hydraulic pressure in the hydraulic helm. The helm pressure sensor is connected to the steering controller for sending a signal representative of the hydraulic pressure in the hydraulic helm to the steering controller. The steering controller actuates the at least one hydraulic pump at least when the hydraulic pressure in the hydraulic helm exceeds a predetermined pressure and the at least one mode selection valve is in the first mode position.

In some implementations of the present technology, a third outdrive is operatively connected to the hull. A third hydraulic steering actuator is operatively connected to the third outdrive for steering the third outdrive. In the first steering mode, the at least one mode selection valve is in the first mode position for hydraulically connecting the hydraulic helm to the third hydraulic steering actuator, and hydraulic pressure is supplied to the third hydraulic steering actuator by the hydraulic helm. In the second steering mode, the at least one mode selection valve is in the second mode position for hydraulically disconnecting the hydraulic helm from the third hydraulic steering actuator.

In some implementations of the present technology, in the second steering mode no hydraulic pressure is supplied to the third hydraulic steering actuator.

In some implementations of the present technology, a thrust input device operatively connected to the first and second outdrives. In the first steering mode, thrust generated by the first and second outdrives is controlled at least in part based on a position of the trust input device. In the second steering mode, thrust generated by the first and second outdrives is controlled at least in part on a position of the auxiliary steering input device.

In some implementations of the present technology, the auxiliary steering input device is a joystick.

In some implementations of the present technology, the first steering mode is a helm steering mode and the second steering mode is a docking mode.

In some implementations of the present technology, the first and second outdrives are outboard engines.

In some implementations of the present technology, a bypass valve is hydraulically connected between a first line and a second line. The first line hydraulically connects the hydraulic helm to the first hydraulic steering actuator. The second line hydraulically connects the first hydraulic steering actuator to the second hydraulic steering actuator. The bypass valve has an opened position and a closed position. In the first steering mode with the bypass valve in the closed position, the hydraulic helm supplies hydraulic pressure to the first and second hydraulic steering actuators to steer the first and second outdrives. In the first steering mode with the bypass valve in the opened position, the hydraulic helm supplies hydraulic pressure to the second hydraulic steering actuator to steer the second outdrive, hydraulic pressure is not supplied to the first hydraulic steering actuator by the hydraulic helm and the first outdrive is not steerable via the hydraulic helm.

In some implementations of the present technology, the second line is a liquid tie bar.

According to another aspect of the present technology, there is provided a hydraulic steering system for a watercraft having first and second outdrives. The hydraulic steering system has a first hydraulic steering actuator for steering the first outdrive, a second hydraulic steering actuator for steering the second outdrive, at least one hydraulic pump selectively supplying hydraulic pressure to at least one of the first and second hydraulic steering actuators, a steering controller operatively connected to the at least one hydraulic pump for controlling the at least one hydraulic pump, a hydraulic helm selectively supplying hydraulic pressure to the first and second hydraulic steering actuators, an auxiliary steering input device connected to the steering controller for sending steering signals to the steering controller, and at least one mode selection valve having a first mode position for steering the watercraft in a first steering mode and a second mode position for steering the watercraft in a second steering mode. In the first steering mode, the at least one mode selection valve is in the first mode position for hydraulically connecting the hydraulic helm to the first and second hydraulic steering actuators, the hydraulic helm is a steering input of the watercraft, and hydraulic pressure is supplied to the first and second hydraulic steering actuators by the hydraulic helm. In the second steering mode, the at least one mode selection valve is in the second mode position for hydraulically disconnecting the hydraulic helm from the first and second hydraulic steering actuators, the auxiliary steering input device is the steering input of the watercraft, and hydraulic pressure is supplied to at least one of the first and second hydraulic steering actuators by the at least one hydraulic pump.

In some implementations of the present technology, in the first steering mode the at least one mode selection valve hydraulically connects the first hydraulic steering actuator to the second hydraulic steering actuator such that turning the hydraulic helm in a first direction causes hydraulic pressure to flow from the hydraulic helm to the first hydraulic steering actuator, from the first steering actuator to the second hydraulic actuator, and from the second hydraulic actuator to the hydraulic helm.

In some implementations of the present technology, the at least one hydraulic pump is a first hydraulic pump supplying hydraulic pressure to the first hydraulic steering actuator. A second hydraulic pump supplies hydraulic pressure to the second hydraulic steering actuator. In the second steering mode the first and second hydraulic steering actuators are hydraulically disconnected from each other, the first hydraulic pump and the first hydraulic steering actuator form a first hydraulic circuit, the second hydraulic pump and the second hydraulic steering actuator form a second hydraulic circuit, and the first and second hydraulic circuits are hydraulically separate from each other.

In some implementations of the present technology, in the second steering mode the at least one mode selection valve hydraulically disconnects the first hydraulic steering actuator from the second hydraulic steering actuator.

In some implementations of the present technology, a mode selector is connected to the steering controller. The steering controller controls a position of the at least one mode selection valve in response to signals received from the mode selector.

In some implementations of the present technology, the at least one mode selection valve is a first mode selection valve selectively hydraulically connecting the hydraulic helm to the first steering actuator. A second mode selection valve selectively hydraulically connects the hydraulic helm to the second steering actuator.

In some implementations of the present technology, in the first steering mode, the first and second hydraulic steering actuators steer the first and second outdrives together in a same direction. In the second steering mode, the first and second hydraulic steering actuators steer the first and second outdrives independently from each other.

In some implementations of the present technology, a pump valve selectively hydraulically connects the at least one hydraulic pump to the at least one of the first and second hydraulic steering actuators. The pump valve hydraulically connects the at least one hydraulic pump to the at least one of the first and second hydraulic steering actuators at least in the second steering mode.

In some implementations of the present technology, a first direction valve is hydraulically connected to the first hydraulic steering actuator for controlling a direction of hydraulic pressure supply to the first hydraulic steering actuator. A second direction valve is hydraulically connected to the second hydraulic steering actuator for controlling a direction of hydraulic pressure supply to the second hydraulic steering actuator.

In some implementations of the present technology, the first and second direction valves are connected to the steering controller. The steering controller controls positions of the first and second direction valves. In the first steering mode, the first and second direction valves remain in a same position regardless of a direction of turning of the hydraulic helm. In the second steering mode, the steering controller controls positions of the first and second direction valves based on a position of the auxiliary steering device.

In some implementations of the present technology, a helm pressure sensor senses a hydraulic pressure in the hydraulic helm. The helm pressure sensor is connected to the steering controller for sending a signal representative of the hydraulic pressure in the hydraulic helm to the steering controller. The steering controller actuates the at least one hydraulic pump at least when the hydraulic pressure in the hydraulic helm exceeds a predetermined pressure and the at least one mode selection valve is in the first mode position.

In some implementations of the present technology where the watercraft has a third outdrive, a third hydraulic steering actuator is operatively connected to the third outdrive for steering the third outdrive. In the first steering mode, the at least one mode selection valve is in the first mode position for hydraulically connecting the hydraulic helm to the third hydraulic steering actuator, and hydraulic pressure is supplied to the third hydraulic steering actuator by the hydraulic helm. In the second steering mode, the at least one mode selection valve is in the second mode position for hydraulically disconnecting the hydraulic helm from the third hydraulic steering actuator.

In some implementations of the present technology, in the second steering mode no hydraulic pressure is supplied to the third hydraulic steering actuator.

In some implementations of the present technology, a thrust input device is operatively connected to the first and second outdrives. In the first steering mode, thrust generated by the first and second outdrives is controlled at least in part based on a position of the trust input device. In the second steering mode, thrust generated by the first and second outdrives is controlled at least in part on a position of the auxiliary steering input device.

In some implementations of the present technology, the auxiliary steering input device is a joystick.

In some implementations of the present technology, the first steering mode is a helm steering mode and the second steering mode is a docking mode.

In some implementations of the present technology, a bypass valve is hydraulically connected between a first line and a second line. The first line hydraulically connects the hydraulic helm to the first hydraulic steering actuator. The second line hydraulically connects the first hydraulic steering actuator to the second hydraulic steering actuator. The bypass valve has an opened position and a closed position. In the first steering mode with the bypass valve in the closed position, the hydraulic helm supplies hydraulic pressure to the first and second hydraulic steering actuators for steering the first and second outdrives. In the first steering mode with the bypass valve in the opened position, the hydraulic helm supplies hydraulic pressure to the second hydraulic steering actuator for steering the second outdrive, hydraulic pressure is not supplied to the first hydraulic steering actuator by the hydraulic helm and the first outdrive is not steerable via the hydraulic helm.

In some implementations of the present technology, the second line is a liquid tie bar.

According to another aspect of the present technology, there is provided a method for steering a watercraft having first and second hydraulically steered outdrives. The method includes selecting one of a first steering mode and a second steering mode. In response to selecting the first steering mode, the method further includes: hydraulically connecting first and second hydraulic steering actuators of the first and second outdrives to a hydraulic helm; and steering the first and second outdrives with the hydraulic helm by supplying hydraulic pressure to the first and second hydraulic steering actuators from the hydraulic helm. In response to selecting the second steering mode, the method further includes: hydraulically disconnecting first and second hydraulic steering actuators from the hydraulic helm; and steering the first and second outdrives with an auxiliary steering input device by supplying hydraulic pressure to the first and second hydraulic steering actuators from a hydraulic pump.

In some implementations of the present technology, the auxiliary steering input device is a joystick and the method further includes controlling thrust generated by the first and second outdrives based at least in part on a position of the joystick in response to selecting the second steering mode.

Explanations and/or definitions of terms provided in the present application take precedence over explanations and/or definitions of these terms that may be found in the document incorporated herein by reference.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

A hydraulic steering system for a watercraft will be described with respect to a watercraft having two outdrives. Outdrives may include, but are not limited to, outboard engines, stern drives, and pod drives. The watercraft as described below is propelled by two outboard engines, each having in internal combustion engine. It is also contemplated that the steering system could be used for different types of watercraft driven by at least two outdrives, including, but not limited to, speed boats and sport boats.

Figure 1:
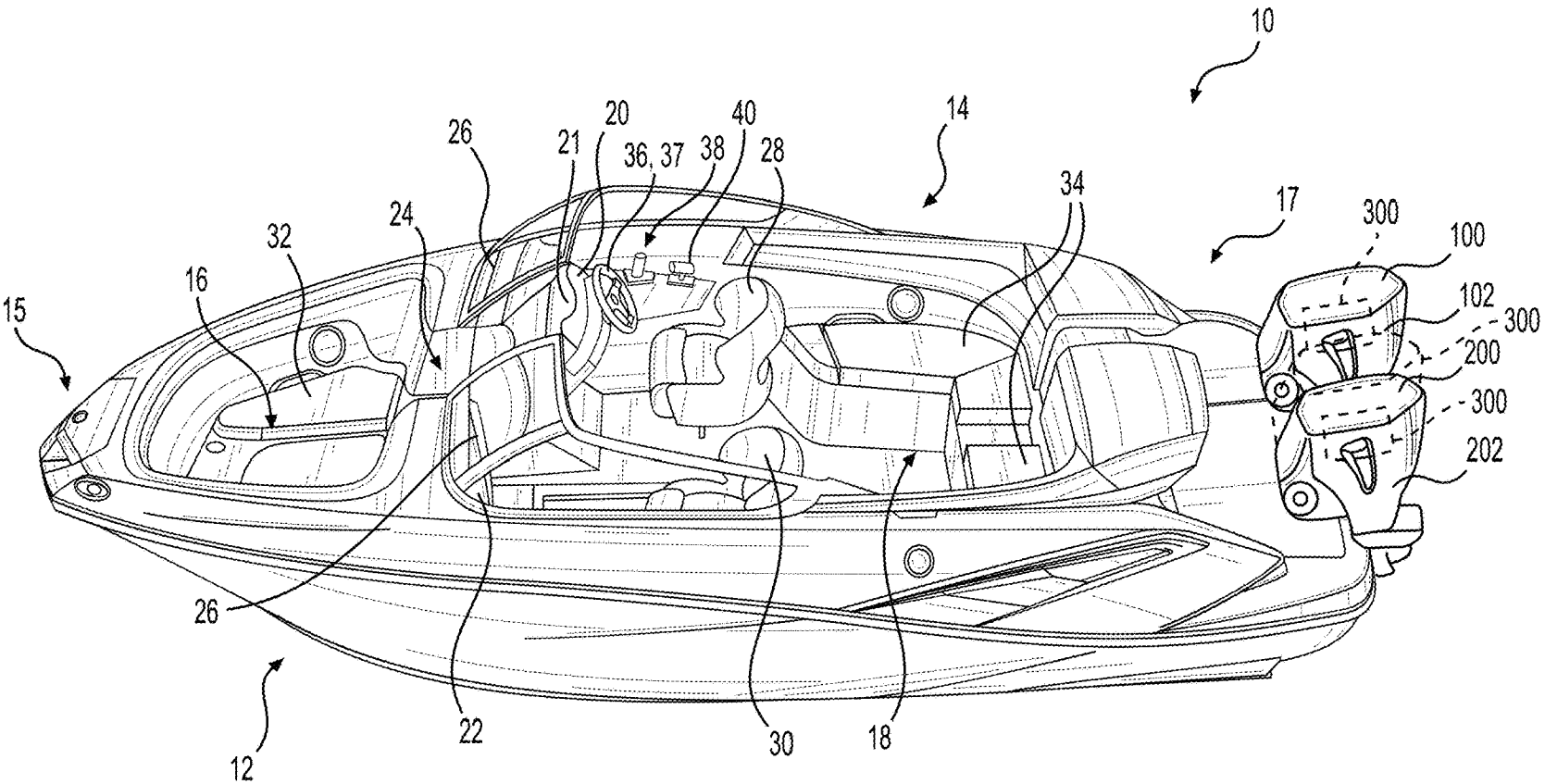
FIG. 1 is a top, left side perspective view of a watercraft.

The general construction of the watercraft 10 is illustrated in FIG. 1. It should be understood that the watercraft 10 could have a construction other than the one described below.

The watercraft 10 has a hull 12 and a deck 14 supported by the hull 12. The watercraft has a front 15 and a rear 17. The deck 14 has a forward passenger area 16 and a rearward passenger area 18. A right console 21 including a dashboard 20 and a left console 22 are disposed on either side of the deck 14 between the two passenger areas 16, 18. A passageway 24 disposed between the two consoles 21, 22 allows for communication between the two passenger areas 16, 18. Windshields 26 are provided over the consoles 21, 22.

A driver seat 28 and a passenger seat 30 are disposed behind the consoles 20 and 22 respectively. Seats 32 and 34 are also provided in the forward and rearward passenger areas 16 and 18 respectively. The dashboard 20 is provided with a hydraulic helm 36 used by an operator of the watercraft 10 to steer the watercraft in certain conditions described below. In the present implementation, the hydraulic helm 36 includes a steering wheel 37. An auxiliary steering input device, in the form of a joystick 38, is also provided for steering the watercraft 10 under certain conditions described below. It is contemplated that the joystick 38 could be replaced by a knob, track pad, multiple levers or any other device allowing for multi-directional input.

The watercraft 10 has a twin engine arrangement. The watercraft 10 includes an outboard engine 100 with an internal combustion engine 102 to a rear, starboard side of the watercraft 10 and an outboard engine 200 with an internal combustion engine 202 toward a rear, port side of the watercraft 10. It is contemplated that the outboard engines 100, 200 could be equipped with different kinds of motors, including, but not limited to: electric motors and hybrid internal combustion-electric motors. The outboard engines 100, 200 are similar except that their propellers (not shown) turn in opposite directions during standard operation. The outboard engines 100, 200 are rotatably connected to the deck 14, but it is contemplated that the engines 100, 200 could be rotatably connected to the hull 12. A thrust input device in the form of a throttle lever 40 is provided to provide control of thrust created by the engines 100, 200 under certain conditions as will be described below. It is contemplated that two throttle levers 40 could be provided to separately control each of the engines 100, 200. It is contemplated that the throttle lever 40 could be replaced with a throttle pedal, a twist grip, a finger actuated throttle lever or any other device allowing the driver of the watercraft 10 to control the thrust generated by the outboard engines 100, 200. In an implementation described below, the watercraft is provided with a central outboard engine 300 (shown in dotted lines in FIG. 1) disposed laterally between the outboard engines 100, 200.

The watercraft 10 includes other features not described herein, such as electrical and fuel systems. It should be understood that such features are nonetheless present in the watercraft 10.

As described above, the watercraft 10 includes a hydraulic helm 36 and a joystick 38. These two steering inputs are used independently and cannot be used at the same time. When the hydraulic helm 36 is used to steer the watercraft 10, the watercraft 10 is described herein as being in a helm steering mode. The joystick 38 is provided to allow, amongst other things, the operator of the watercraft 10 to have translational manoeuvrability at generally low speeds. When the joystick 38 is used to steer the watercraft 10, the watercraft 10 is described herein as being in a docking mode.

Figure 2:
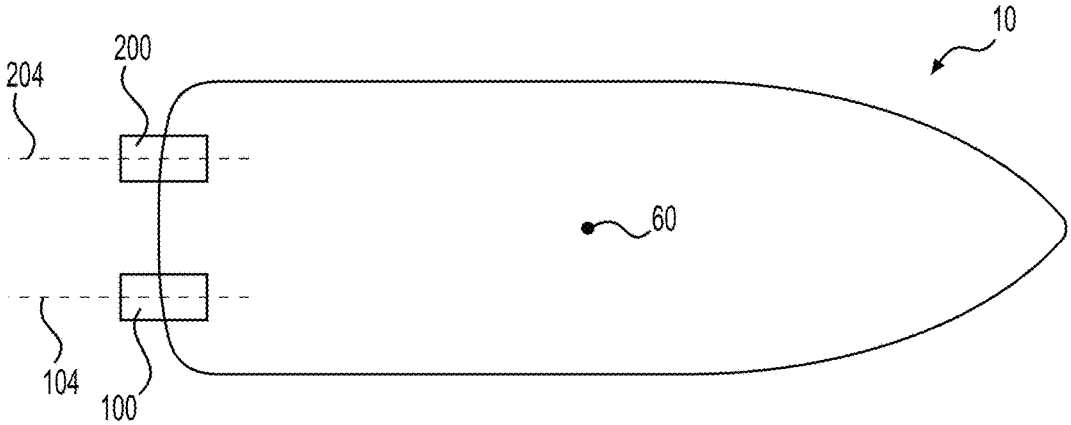
FIG. 2 is a schematic, top plan view of the watercraft of FIG. 1, with two outboard engines in a forward facing arrangement.
Figure 6:
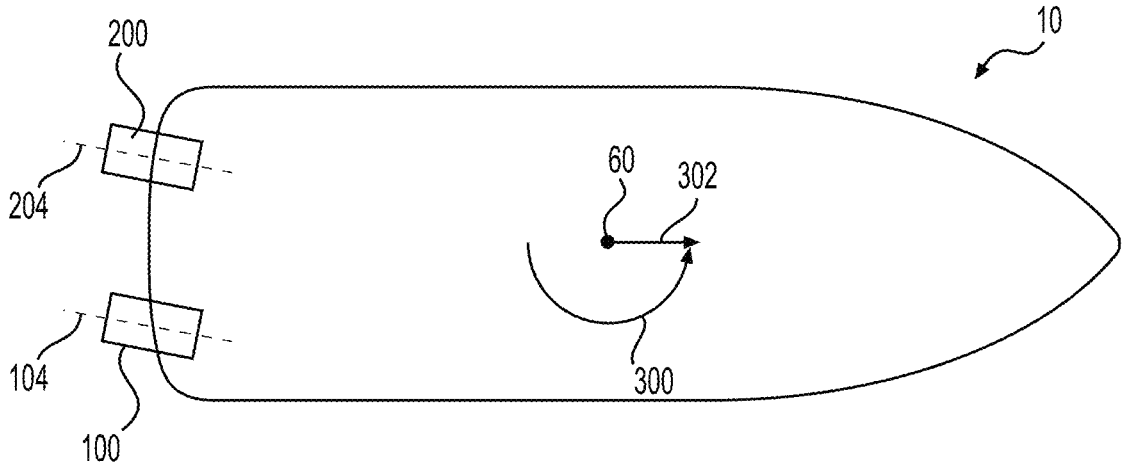
FIG. 6 is the schematic watercraft of FIG. 2, with the outboard engines steered to make a left turn.

When the driver initiates a helm steering mode, control of steering and thrust of the two engines 100, 200 of the watercraft 10 are provided by the hydraulic helm 36 and the throttle lever 40, and not the joystick 38 as will be described below. When the hydraulic helm 36 is disposed in a centered, neutral position, the engines 100 are forward facing as shown in FIG. 2. In the forward facing arrangement, thrust axes 104, 204 of the engines 100, 200 are generally perpendicular to the hull 12, and provide generally forward motion upon thrust from the engines 100, 200. When the hydraulic helm 36 is turned, the two engines 100, 200 are turned by a same amount in a same direction together. FIG. 6 illustrates a position of the outboard engines 100, 200 in response to the hydraulic helm 36 being turned left (i.e. counter-clockwise). As can be seen in FIG. 6, the combination of the forward thrusts generated by the outboard engines 100, 200 generates a forward thrust 302 and a torque 300 about a center of rotation 60 of the watercraft 10, the center of rotation 60 being a combination of the center of gravity, moment of inertia, drag and other forces which may be acting on the watercraft 10. As a result, the watercraft 10 turns left in an arcuate motion.

When the driver initiates docking mode, control of steering and thrust of the two engines 100, 200 of the watercraft 10 are transferred from the hydraulic helm 36 and the throttle lever 40 to the joystick 38 as will be described below. Upon entering the docking mode, the engines 100, 200 rotate from a forward facing arrangement, illustrated in FIG. 2, to a splayed arrangement.

Figure 3:
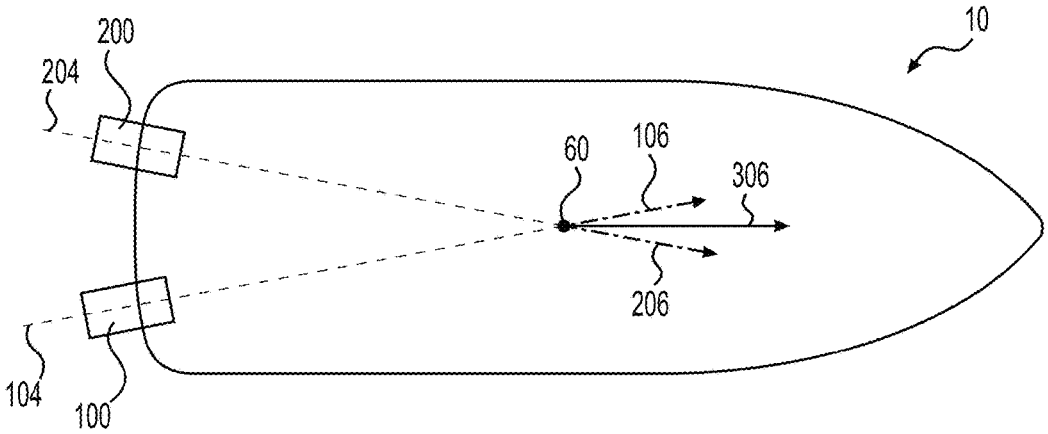
FIG. 3 is the schematic watercraft of FIG. 2, with the outboard engines in a splayed arrangement producing forward resultant thrust.
Figure 4:
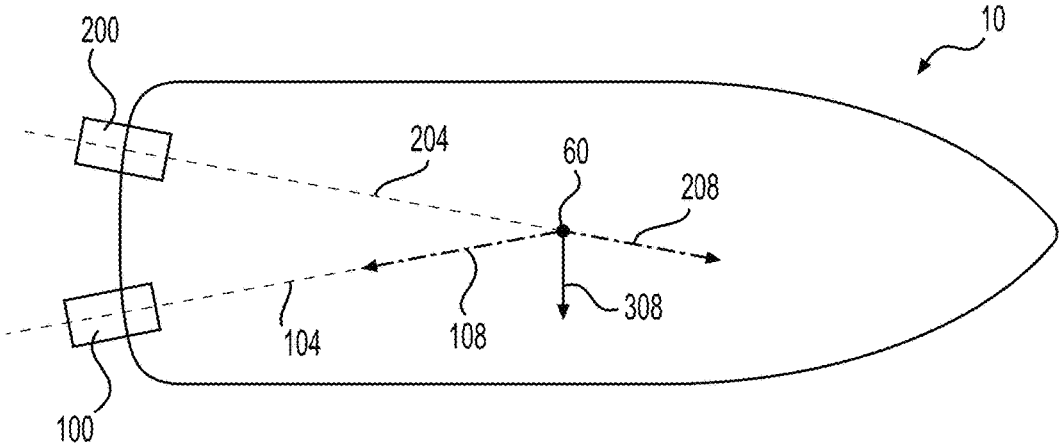
FIG. 4 is the schematic watercraft of FIG. 2, with the outboard engines in the splayed arrangement producing resultant thrust toward a starboard side.
Figure 5:
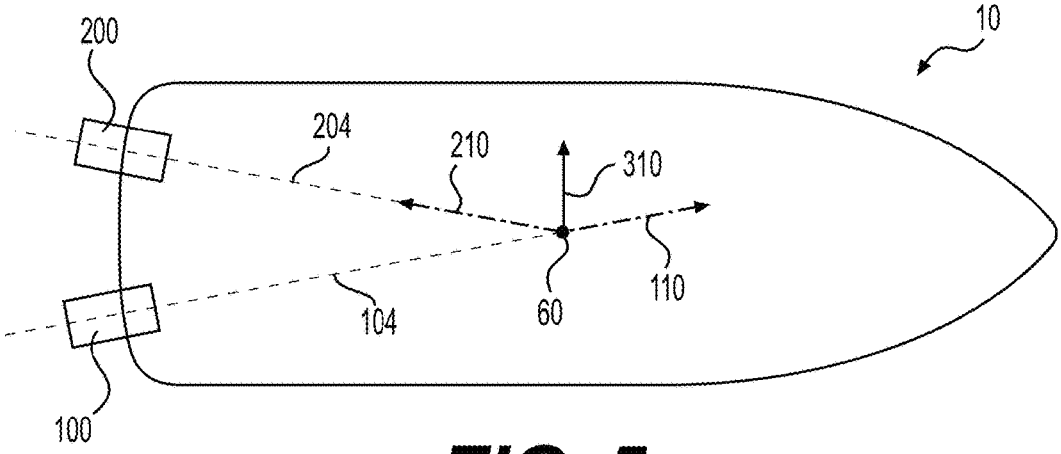
FIG. 5 is the schematic watercraft of FIG. 2, with the outboard engines in the splayed arrangement producing resultant thrust toward a port side.

In the splayed arrangement, illustrated in FIGS. 3 to 5, the thrust axes 104, 204 of each of the engines 100, 200 are directed toward the center of rotation 60 of the watercraft 10. The sum of the two thrusts combined at the center of rotation 60 is referred to as a resultant thrust of the engines 100, 200. With the engines 100, 200 in the splayed arrangement with the resultant thrust at the center of rotation 60 of the watercraft 10, generally translational motion (at generally low speeds) can be achieved. The true motion of the watercraft 10 will depend on operating conditions.

As an example, resultant thrust for forward motion can be produced for the watercraft 10 in the docking mode. As seen in FIG. 3, the engines 100, 200 are in the splayed arrangement, where their thrust axes 104, 204 are pointed at the center of rotation 60. The starboard engine 100 produces a forward thrust 106 and the port engine 200 produces an equal forward thrust 206. The left and right components of the thrusts 106, 206 cancel at the center of rotation 60 and the resultant thrust 306 retains only forward directed components of the thrusts 106, 206. Similarly, when the engines 100, 200 produce equal, rearward thrust, the resultant thrust (not shown) is toward the rear.

As shown in FIGS. 4 and 5, the resultant thrust can similarly be created toward the starboard or port directions, to create starboard and port translational motion of the watercraft 10. To produce starboard or port directed resultant thrust, the engines 100, 200 create oppositely directed thrust, with their thrust axes 104, 204 still aligned with the center of rotation 60 in the splayed arrangement.

Starboard resultant thrust 308 is illustrated in FIG. 4, where the starboard engine 100 produces rearward directed thrust 10 and the port engine 200 produces forward directed thrust 208, with the thrusts 108, 208 being generally equal in strength. The forward and back components of the individual thrusts 108, 208 cancel, leaving the starboard directed resultant thrust 308 centered at the center of rotation 60 of the watercraft 10, which can create starboard translational motion of the watercraft 10.

Similarly, port directed resultant thrust 310 is illustrated in FIG. 5, where the starboard engine 100 produces forward directed thrust 110 and the port engine 200 produces rearward directed thrust 210, with the thrusts 110, 210 being generally equal in strength. The forward and backward components of the individual thrusts 110, 210 cancel, leaving the port directed resultant thrust 310 centered at the center of rotation 60 of the watercraft 10, in order to create port translational motion of the watercraft 10.

In addition, uneven thrust strength and steering of the engines 100, 200 to different angles in the splayed arrangement can be used to create various resultant thrust directions. For example, directing the thrust axes 104, 204 of each engine 100, 200 such that the intersect at a point other than the center of rotation 60 will cause the watercraft to pivot towards port or starboard, thereby enabling control of the yaw of the watercraft 10.

Figure 7:
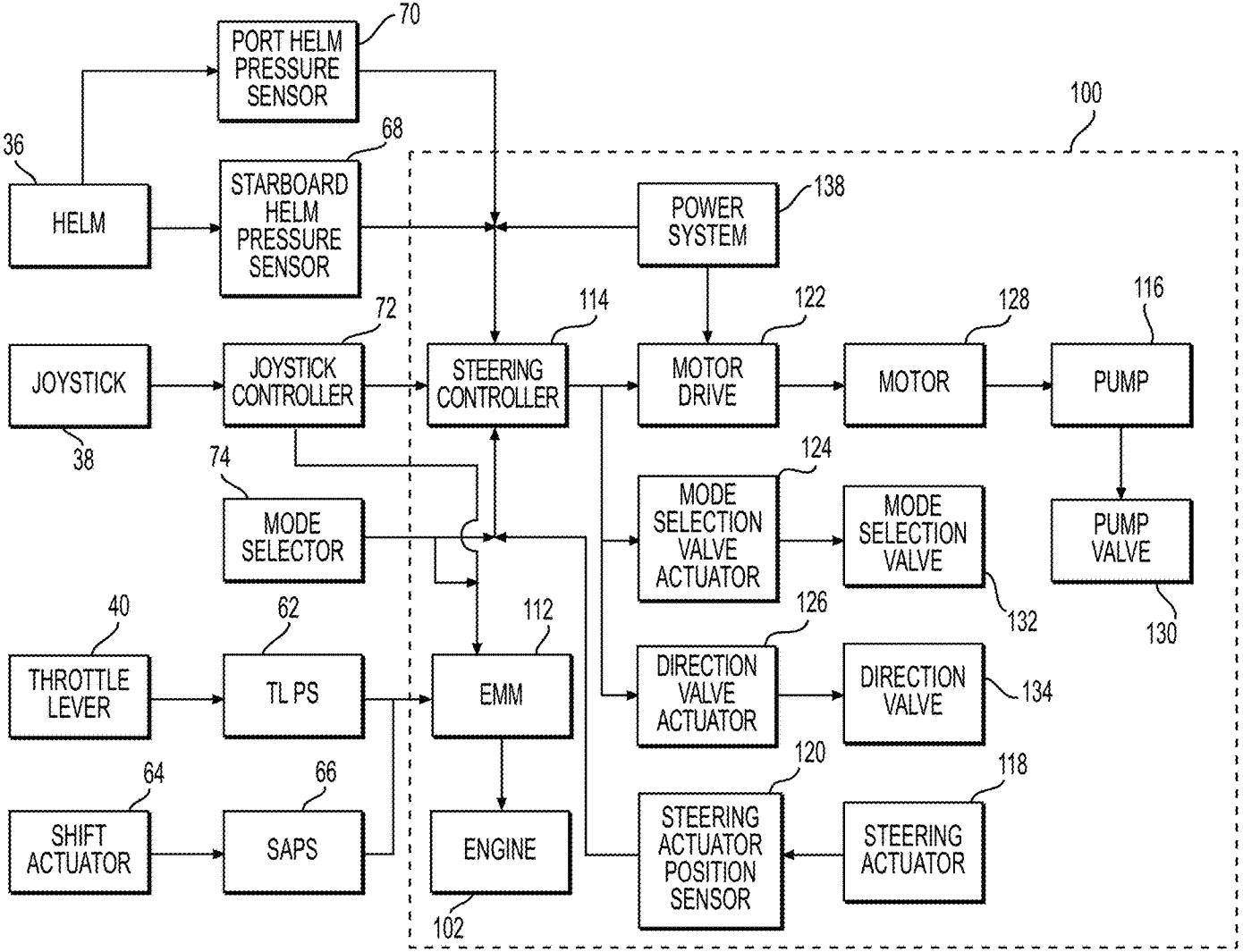
FIG. 7 is a schematic illustration of components of a starboard outboard engine of the watercraft of FIG. 1 and associated components of the watercraft of FIG. 1.

Turning now to FIG. 7, components of the watercraft 10 associated with steering and propelling the watercraft 10 will be described. As is common on vessels with two outboard engines, the outboard engines 100, 200 will be geared such that their respective propellers rotate in opposite directions, a feature known as "counter rotation". Other than propeller rotation, both outboard engines 100, 200 are essentially the same. For simplicity, except where indicated otherwise, only the components of the starboard outboard engine 100 are shown in FIG. 7. Throughout the figures, unless otherwise indicated, the components of the port outboard engine 200 corresponding to those of the starboard outboard engine 100 are labelled with reference numbers that are one hundred more than the reference numbers of the components of the starboard outboard engine 100 (i.e. they start with a "2" instead of a "1"). For simplicity, only the components of the starboard outboard engine 100 will be described in detail herein.

As can be seen in FIG. 7, a throttle lever position sensor (TLPS) 62 is connected to the throttle lever 40 to sense a position of the throttle lever 40 and send a signal representative of the position of the throttle lever 40 to an engine management module (EMM) 112. The watercraft 10 is also provided with a shift actuator 64. The shift actuator 64 is a device actuated by the driver of the watercraft 10 to control the direction of thrust, either forward or rearward, while in the helm steering mode. In one implementation, the shift actuator 64 is a lever similar to the throttle lever 40, but it is contemplated that it could be buttons or one or more switches. In another implementation, the throttle lever 40 and the shift actuator 64 are a single lever. This lever has a first range of positions corresponding to forward thrust and second range of positions corresponding to rearward thrust. A shift actuator position sensor (SAPS) 66 is connected to the shift actuator 64 to sense a position of the shift actuator 64 and send a signal representative of a position of the shift actuator 64 to the EMM 112. Based on the signals received from the TLPS 62 and the SAPS 66, and signals from other sensors not described herein, the EMM 112 controls the operation of the engine 102 and a position of a transmission (not shown) of the outboard engine 100.

Starboard and port helm pressure sensors 68, 70 sense the hydraulic pressure supplied by the hydraulic helm 36 toward the starboard and port outboard engines 100, 200 respectively as will be described in more detail below. The pressure sensors 68, 70 send signals representative of the sensed hydraulic pressures to a steering controller 114. Based on the signals from the pressure sensor 68, 70, the steering controller 114 determines if, while in the helm steering mode, steering should be assisted by a hydraulic pump 116 or 216, depending on the steering direction. When steering is assisted by one of the hydraulic pumps 116, 216 while in the helm steering mode, the helm steering mode is referred to herein as the power steering mode. In the present implementation the hydraulic pumps 116, 216 are unidirectional rotary pumps, but other types of pumps are contemplated.

A joystick controller 72 receives signals from a joystick position sensor (not shown) that is built-in the joystick 38, but which could be a separate sensor. Based on the direction and displacement angle of the joystick 38, the joystick controller 72 determines the corresponding steering angles of the outboard engines 100, 200, and the corresponding thrusts and thrust directions to be generated by the outboard engines 100, 200. In some implementations, it is contemplated that the joystick 38 could also be twisted to control a yaw motion of the watercraft 10, in which case the joystick controller 72 would also receive signals representative of the twist angle of the joystick 38. The joystick controller 72 sends signals corresponding to the steering angles to the steering controllers 114, 214 which control the components of the hydraulic steering system accordingly. The joystick controller 72 sends signals corresponding to the thrusts and thrust directions to the starboard EMM 112 and the port EMM (not shown) which control the engines 102, 202 and transmissions accordingly. The steering controllers 114, 214 and the EMMs operate in response to the signals received from the joystick controller 72 when in the docking mode.

A mode selector 74 provided near the joystick 38 in the watercraft 10, or at some other convenient location, allows the driver to select which of the helm steering mode and the docking mode is to be used to control the watercraft 10. The mode selector 74 sends a signal representative of the desired mode to the steering controllers 114, 214 and the EMMs. In the helm steering mode, the watercraft 10 is controlled using the hydraulic helm 36, the throttle lever 40 and the shift actuator 64, and inputs from the joystick 38 do not affect steering and watercraft speed. In the docking mode, the watercraft 10 is controlled using the joystick 38, and inputs from the hydraulic helm 36, the throttle lever 40 and the shift actuator 64 do not affect steering and watercraft speed. It is contemplated that a physical mode selector 74 could be omitted and that the helm steering mode could be automatically engaged upon moving the steering wheel 37 and that the docking mode could be automatically engaged upon moving the joystick 38. It is also contemplated that the docking mode could only be engaged if the watercraft 10 is at rest or moving at a low speed.

A hydraulic steering actuator 118 steers the outboard engine 100. In the present implementation, the hydraulic steering actuator 118 is a rotary hydraulic actuator, but other hydraulic actuators such as linear actuators are contemplated. U.S. Pat. No. 7,736,206 B1, issued Jun. 15, 2010, the entirety of which is incorporated herein by reference, provides additional details regarding hydraulic steering actuators similar in construction to the hydraulic steering actuator 118. A steering actuator position sensor 120 senses a position of the steering actuator 118 and sends a signal representative of this position to the steering controller 114. The steering controller 114 uses this signal to determine the steering position of the outboard engine 100. It is contemplated that the steering actuator position sensor 120 could be replaced by another sensor that can determine the steering position of the outboard engine 100.

Figure 11:
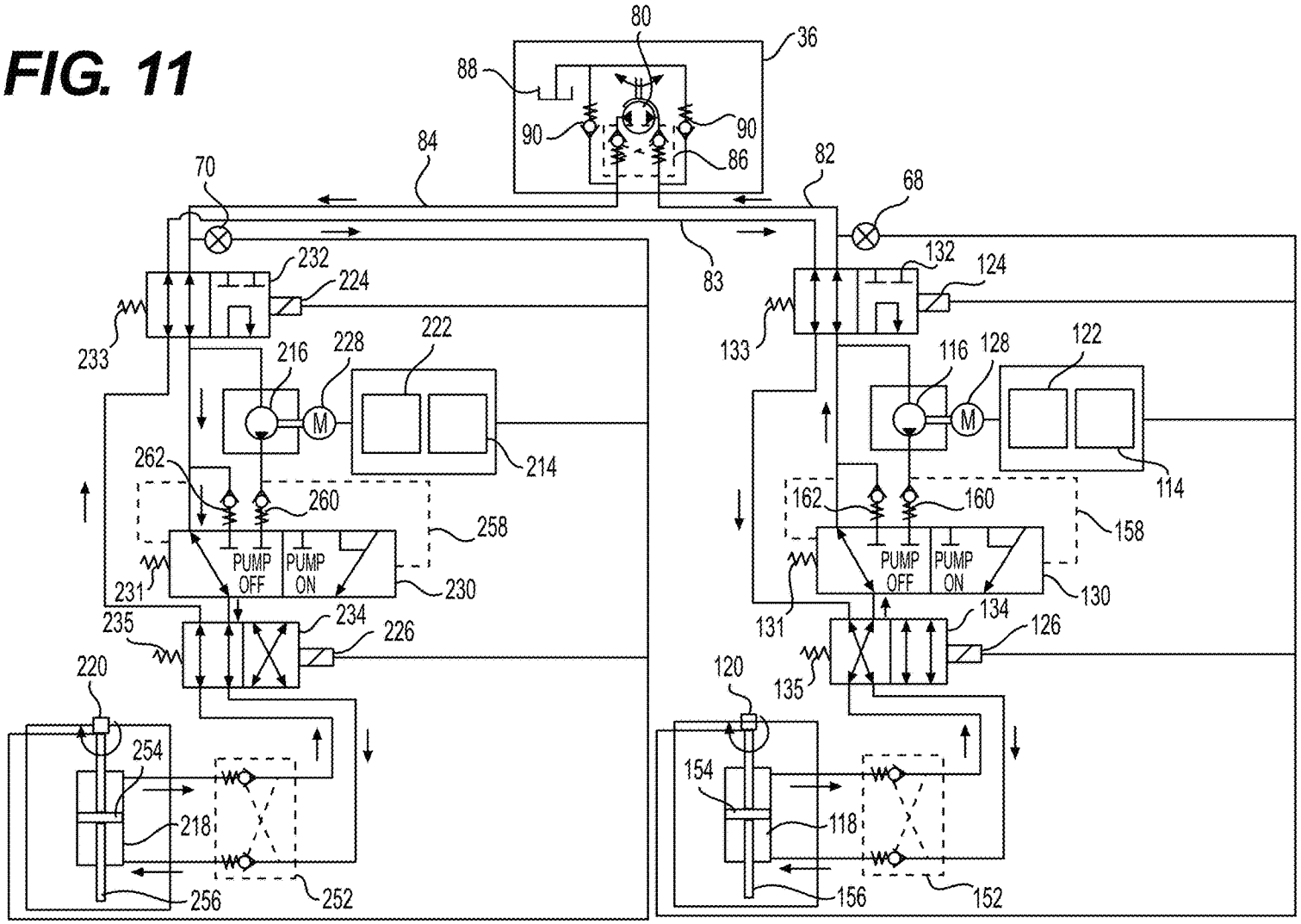
FIG. 11 is a schematic view of a hydraulic steering system of the watercraft of FIG. 1 in a helm steering mode.

Based on the various signals described above that it receives, the steering controller 114 controls a motor drive 122, a mode selection valve actuator 124 and a direction valve actuator 126. The motor drive 122 consists of one or more circuits that drive a pump motor 128 based on a signal received from the steering controller 114 to operate the pump 116 as determined by the steering controller 114. As will be described below, the operational status of the pump 116 (on or off) determines a position of a pump valve 130. In the present implementation, the pump valve 130 has two positions (pump on, pump off), but it is contemplated that it could have one or more intermediate positions to provide a smooth transition between the regular helm steering mode (i.e. pump off) and the power steering mode (i.e. pump on). The mode selection valve actuator 124 controls a position of a mode selection valve 132 based on a signal received from the steering controller 114. The position of the mode selection valve 132 changes based on the one of the helm steering mode and the docking mode that has been selected by the mode selector 74. The direction valve actuator 126 controls a position of a direction valve 134 based on a signal received from the steering controller 114. The direction valve 134 controls the direction of the flow of hydraulic fluid towards and away from the hydraulic steering actuator 118, thereby determining the steering direction of the outboard engine 100. In the present implementation, the mode selection valve actuator 124 and the direction valve actuator 126 are solenoids operating at a voltage of 12 volts, but other types of actuators are contemplated. Springs 131, 133, 135 (FIG. 11)

bias the pump valve 130, the mode selection valve 132 and the direction valve 134 respectively toward their positions shown in FIG. 11.

A power system 138 supplies electrical power to the steering controller 114 and the motor drive 122. It is contemplated that the power system 138 could also provide electrical power to the joystick controller 72, or that the joystick controller 72 could have a different source of power. The power system 138 includes one or more of an alternator, a battery and a super-capacitor.

The joystick controller 72, the mode selector 74, the steering controllers 114, 214, the EMMs, the motor drives 122, 222 and the various actuators and sensors described above and shown in the figures exchange signals over a controller area network (CAN bus), but other communication protocols are contemplated. It is also contemplated that the various components could communicate wirelessly.

It is contemplated that the functions of the joystick controller 72, the steering controllers 114, 214, the EMMs, and the motor drives 122, 222 could be combined into fewer controllers than illustrated or could be split up into more controllers than illustrated.

Figure 8:
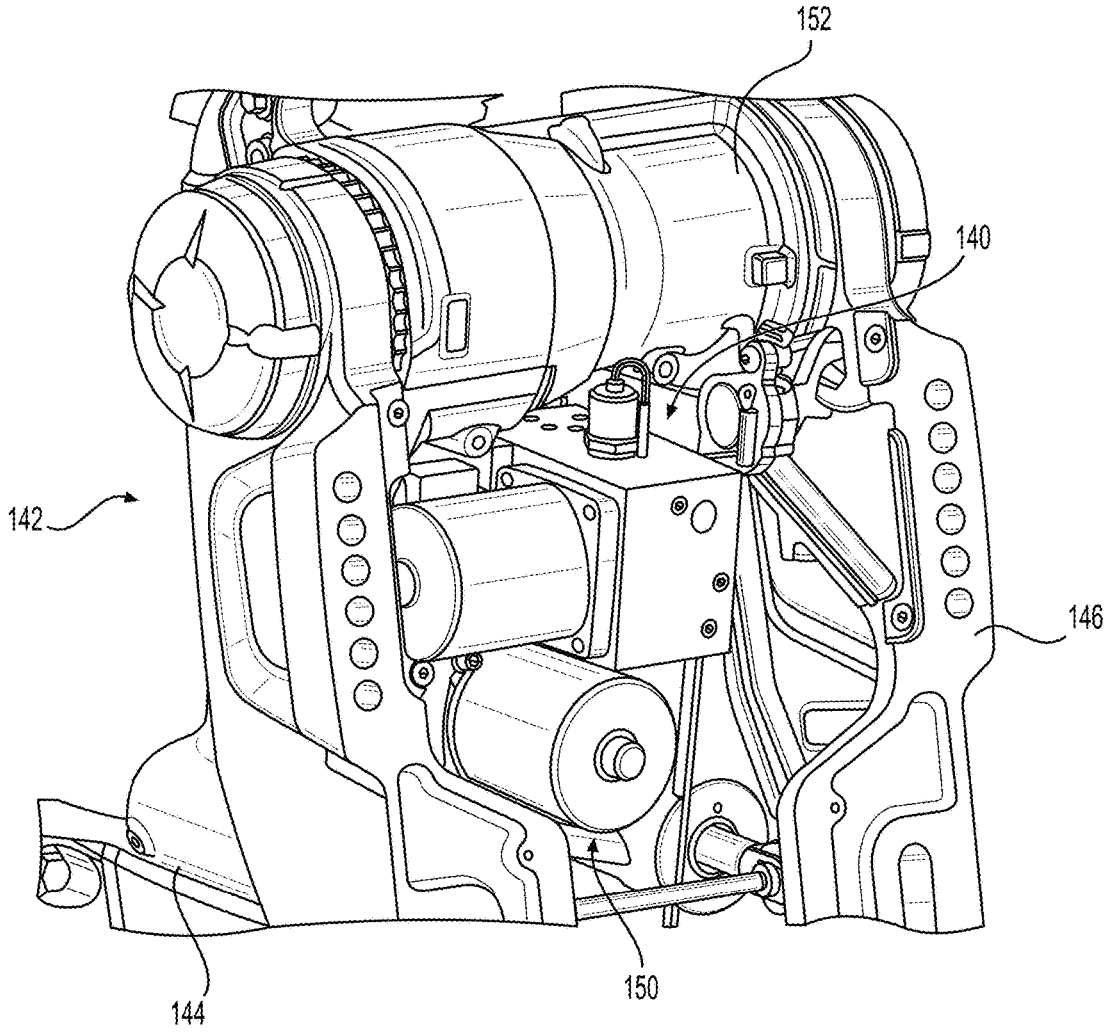
FIG. 8 is a perspective view taken from a front, right side of a portion of a bracket assembly of the starboard outboard engine of the watercraft of FIG. 1.
Figure 9:
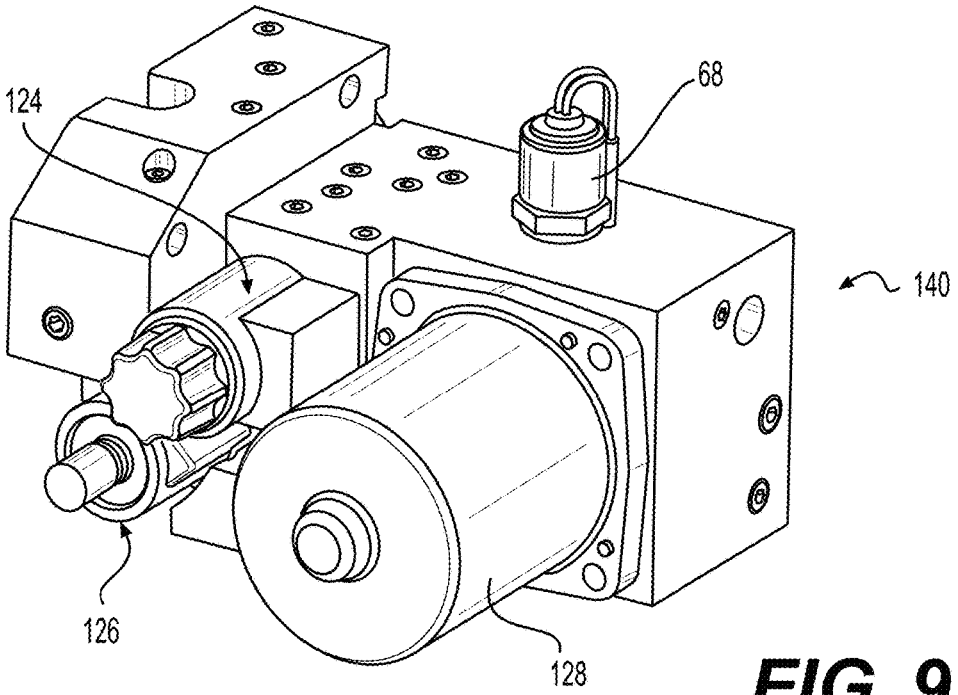
FIG. 9 is a perspective view taken from a front, right side of a hydraulic steering unit of the starboard outboard engine of the watercraft of FIG. 1.
Figure 10:
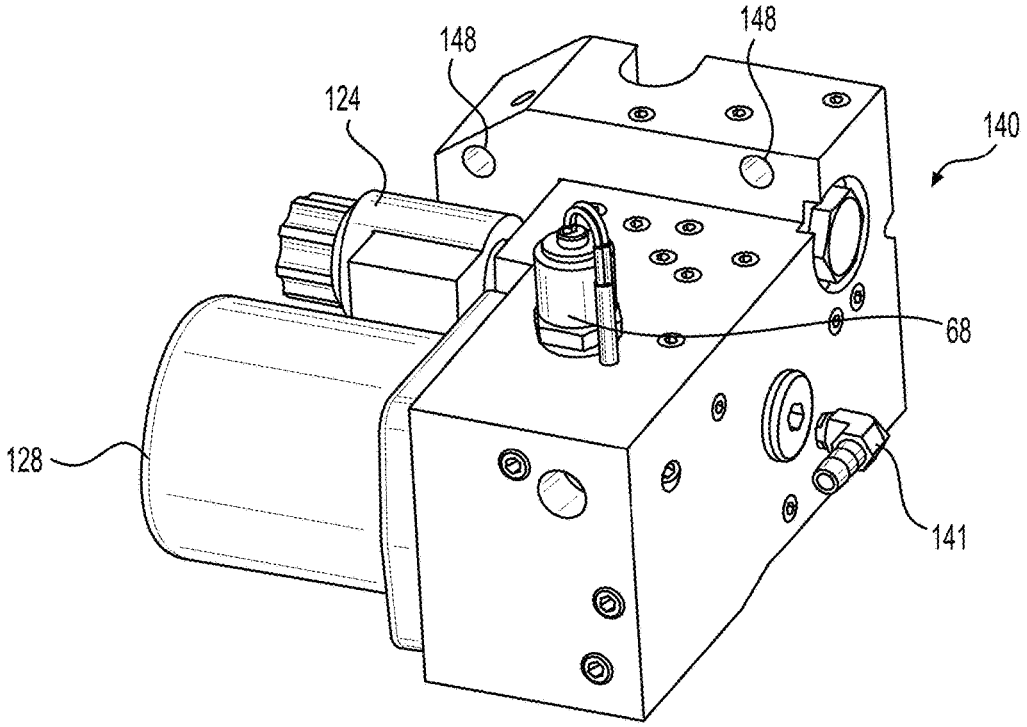
FIG. 10 is a perspective view taken from a front, left side of the hydraulic steering unit of FIG. 9.

The starboard helm pressure sensor 68, the motor 128, the pump 116, the pump valve 130, the mode selection valve actuator 124, the mode selection valve 132, the direction valve actuator 126 and the direction valve 134 are combined in a hydraulic steering unit 140 shown in FIGS. 8 to 10. A similar hydraulic steering unit (not shown) is provided for the port outboard engine 200. A connector 141 (FIG. 10) connects the hydraulic steering unit 140 to a hydraulic fluid reservoir (not shown). The hydraulic steering unit 140 is mounted to a bracket assembly 142 (FIG. 8). The bracket assembly 142 includes a swivel bracket 144 carrying the outboard engine 100 for pivotal movement about a steering axis and a stern bracket 146 supporting the swivel bracket 144 and the outboard engine 100 for pivotal movement about a tilt axis extending generally horizontally. The stern bracket 146 is connected to the transom of the watercraft 10. The hydraulic steering unit 140 is connected to the swivel bracket 144 by fasteners (not shown) connected through holes 148 in the hydraulic steering unit 140. The hydraulic steering unit 140 fluidly communicates with the steering actuator 118 provided in the swivel bracket 144 via passages formed in the swivel bracket 144. It is contemplated that the hydraulic steering unit 140 could be connected elsewhere. It is also contemplated that the various components provided in the hydraulic steering unit 140 could be separated in multiple units.

A hydraulic tilt-trim unit 150 is mounted to the swivel bracket 144 below the hydraulic steering unit 140. The hydraulic tilt-trim unit 150 includes a pump, a valve and a valve actuator (not shown). The hydraulic tilt-trim unit 150 supplies hydraulic pressure to a hydraulic tilt-trim actuator 152. As can be seen in FIG. 8, the hydraulic tilt-trim actuator 152 is connected between the swivel bracket 144 and the stern bracket 146. The hydraulic tilt-trim actuator 152 pivot the swivel bracket 144 and the outboard engine 100 about the horizontal tilt axis to tilt or trim the outboard engine 100.

It is contemplated that by modifying the existing valves described above and/or by adding valves, a single pump could be provided instead of the two pumps 116, 216. It is also contemplated that the pumps 116, 216 could be bidirectional pumps, in which case the direction valves 134, 234 could be omitted. It is also contemplated that each pump 116, 216 could be replaced by two pumps, one per steering direction, in which case the direction valves 134, 234 could be omitted. It is also contemplated that hydraulic steering system could be modified such that the two mode selection valves 132, 232 could be replaced with a single mode selection valve.

Turning now to FIG. 11, the hydraulic helm 36 will be described in more detail. The steering wheel 37 (not shown in FIG. 11) is connected to an input pump 80. The input pump 80 operates in response to rotation of the steering wheel 37. Depending on a direction of rotation of the steering wheel 37, hydraulic fluid is pushed out of the helm assembly 36 via a line 82 or a line 84 to supply hydraulic pressure. The helm pressure sensors 68, 70 sense the hydraulic pressures in the lines 82, 84 respectively. A locking valve 86 connected between the input pump 80 and the lines 82, 84 fluidly communicates the input pump 80 with both lines 82, 84 when the input pump 80 is operating (i.e. the steering wheel 37 is turned). The locking valve 86 prevents the flow of hydraulic fluid back toward the input pump 80 via the lines 82, 84 when the input pump 80 is not operating (i.e. the steering wheel 37 is stationary). The input pump 80 is hydraulically connected to a hydraulic fluid reservoir 88. High pressure blow-off valves 90 are connected between the lines 82, 84 and the reservoir 88 to return hydraulic fluid to the reservoir from the lines 82, 84 should the hydraulic pressure in the lines 82, 84 become too high.

As can be seen in FIG. 11, a locking valve 152 is provided between the direction valve 134 and the hydraulic steering actuator 118. Similarly, a locking valve 252 is provided between the direction valve 234 and the hydraulic steering actuator 218. The locking valves 152, 252 prevent inadvertent movement of the rotary actuators 118, 218.

With reference to FIG. 11, the operation of the hydraulic steering system to make a left turn while in the helm steering mode will be described. In the helm steering mode, the mode selection valve actuators 124, 224 move the mode selection valves 132, 232 to their helm steering mode positions illustrated in FIG. 11. When the valves 132, 232 are in their helm steering mode positions the hydraulic helm 36 is hydraulically connected to the hydraulic steering actuators 118, 218 such that the hydraulic helm 36 is the steering input of the watercraft 10. The hydraulic steering actuators 118, 218 are also hydraulically connected with each other. Similarly, in the helm steering mode, the direction valve actuators 126, 226 move the direction valves 134, 234 to their helm steering mode positions illustrated in FIG. 11.

In the example of FIG. 11, the difference in hydraulic pressure in lines 82, 84 as sensed by the helm pressure sensors 68, 70 is below a predetermined threshold and no steering assistance from the pumps 116, 216 is required. This would be the case when slowly turning the steering wheel 37 and/or when the watercraft 10 is operating a low speed. Since no steering assistance from the pumps 116, 216 is required, the motors 128, 228 do not operate the pumps 116, 216 and the pump valves 130, 230 are in their pump off positions shown in FIG. 11.

As a result of the above arrangement of the valves 130, 132, 134, 230, 232, 234, when the steering wheel 37 is turned to make a left turn, the hydraulic helm 36 supplies hydraulic pressure to the steering actuator 218, and the steering actuator 218 supplies hydraulic pressure to the steering actuator 118 such that both outboard engines 100, 200 are steered by the same amount in the same direction in order to make a left turn, such as in the example illustrated in FIG. 6.

More specifically, as indicated by the by arrows next to the lines connecting the various components, from the hydraulic helm 36 hydraulic fluid flows toward the mode selection valve 232 via the line 84. From the mode selection valve 232, hydraulic fluid flows toward the pump valve 230, then from the pump valve 230 toward the direction valve 234. From the direction valve 234, hydraulic fluid flows toward the hydraulic steering actuator 218. Hydraulic fluid enters the hydraulic steering actuator 218 below a piston 254 of the hydraulic steering actuator 218, causing the piston 254 to move up and turn a shaft 256 of the hydraulic steering actuator 218, thereby steering the port outboard engine 200 to make a left turn. As the piston 254 moves up, hydraulic fluid above the piston 254 is pushed out of the hydraulic steering actuator 218. From the hydraulic steering actuator 218, hydraulic fluid flows toward the direction valve 234 and then from the direction valve 234 toward the mode selection valve 232.

From the mode selection valve 232, hydraulic fluid flows toward the mode selection valve 132 via line 83. The line 83 is sometimes referred to as a liquid tie bar because it hydraulically connects both outboard engines 100, 200 for steering and this function is reminiscent of solid tie bars that are sometimes used to mechanically connect two outboard engines for steering. From the mode selection valve 132, hydraulic fluid flows toward the direction valve 134. From the direction valve 134, hydraulic fluid flows toward the hydraulic steering actuator 118. Hydraulic fluid enters the hydraulic steering actuator 118 below a piston 154 of the hydraulic steering actuator 118, causing the piston 154 to move up and turn a shaft 156 of the hydraulic steering actuator 118, thereby steering the starboard outboard engine 100 to make a left turn. As the piston 154 moves up, hydraulic fluid above the piston 154 is pushed out of the hydraulic steering actuator 118. From the hydraulic steering actuator 118, hydraulic fluid flows toward the direction valve 134 and then toward the pump valve 130. From the pump valve 130, hydraulic fluid flows toward the mode selection valve 132. Finally, from the mode selection valve 132, hydraulic fluid flows toward the hydraulic helm 36 via the line 82. It will be appreciated that when the steering wheel 37 is turned to make a right turn, hydraulic fluid will follow the same path in reverse.

Figure 12:
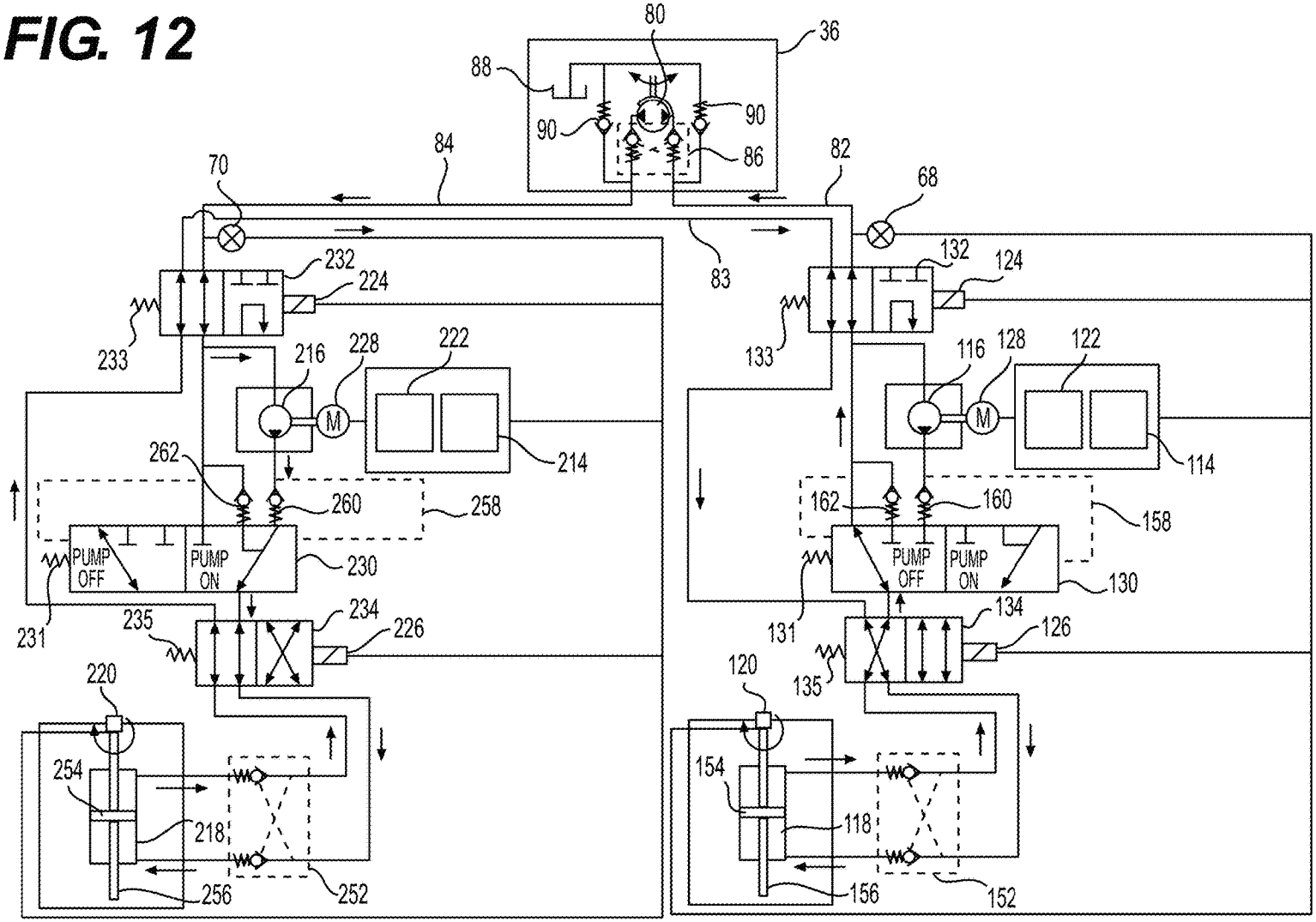
FIG. 12 is a schematic view of the hydraulic steering system of the watercraft of FIG. 1 in a power steering mode.

With reference to FIG. 12, the operation of the hydraulic steering system to make a left turn while in the power steering mode will be described. The power steering mode is similar to the helm steering mode, but with one of the pumps 116, 216 being operational, in this case the port pump 216. In the power steering mode, the mode selection valves 132, 232 and the direction valves 134, 234 are in the same positions as in the helm steering mode illustrated in FIG. 11.

In the example of FIG. 12, the difference in hydraulic pressure in the in the lines 82, 84 as sensed by the helm pressure sensors 68, 70 is above the predetermined threshold. When the pressure in the line 84 is much greater than in line 82, steering assistance from the pump 216 is provided for a left turn. This would be the case when quickly turning the steering wheel 37 and/or when the watercraft 10 is operating a high speed. When the inverse is true, steering assistance for a right turn is provided by the pump 116. As such, in the example shown in FIG. 12, the motor 128 does not operate the pump 116 and the pump valve 130 is in its pump off position. However, since steering assistance from the pump 216 is required, the controller 214 sends a signal to the motor drive 222 to turn on the motor 228 to operate the pump 216. When the pump 216 starts to operate, the pump 216 causes hydraulic fluid to flow through the line 258 which moves the pump valve 230 to its pump on position shown in FIG. 12. Once the pump valve 230 is in the pump on position, the ball valve 260 opens, the ball valve 262 closes and the pump 216 fluidly communicates with the hydraulic steering actuator 218. When the difference in hydraulic pressure in the lines 82, 84 falls back below the predetermined threshold, the controller 214 sends a signal to the motor drive 222 to turn off the motor 228 to stop operating the pump 216, as a result of which the pump valve 230 is returned to its pump off position illustrated in FIG. 11.

As a result of the operation of the pump 216 and the above arrangement of the valves 130, 132, 134, 230, 232, 234, when the steering wheel 37 is turned to make a left turn in the power steering mode, the hydraulic helm 36 supplies hydraulic pressure to the pump 216, the pump 216 supplies an additional hydraulic pressure to the steering actuator 218, and the steering actuator 218 supplies hydraulically pressure to the steering actuator 118 such that both outboard engines 100, 200 are steered in the same direction in order to make a left turn, such as in the example illustrated in FIG. 6.

More specifically, as indicated by the by arrows next to the lines connecting the various components, from the hydraulic helm 36 hydraulic fluid flows toward the mode selection valve 232 via the line 84. From the mode selection valve 232, hydraulic fluid flows toward the pump 216 and then the pump valve 230. From the pump valve 230, hydraulic fluid then flows toward the direction valve 234. From the direction valve 234, hydraulic fluid flows toward the hydraulic steering actuator 218. Hydraulic fluid enters the hydraulic steering actuator 218 below the piston 254, causing the piston 254 to move up and turn the shaft 256, thereby steering the port outboard engine 200 to make a left turn. As the piston 254 moves up, hydraulic fluid above the piston 254 is pushed out of the hydraulic steering actuator 218. From the hydraulic steering actuator 218, hydraulic fluid flows toward the direction valve 234 and then from the direction valve 234 toward the mode selection valve 232.

From the mode selection valve 232, hydraulic fluid flows toward the mode selection valve 132 via the line 83. From the mode selection valve 132, hydraulic fluid flows toward the direction valve 134. From the direction valve 134, hydraulic fluid flows toward the hydraulic steering actuator 118. Hydraulic fluid enters the hydraulic steering actuator 118 below the piston 154, causing the piston 154 to move up and turn the shaft 156, thereby steering the starboard outboard engine 100 to make a left turn. As the piston 154 moves up, hydraulic fluid above the piston 154 is pushed out of the hydraulic steering actuator 118. From the hydraulic steering actuator 118, hydraulic fluid flows toward the direction valve 134 and then toward the pump valve 130. From the pump valve 130, hydraulic fluid flows toward the mode selection valve 132. Finally, from the mode selection valve 132, hydraulic fluid flows toward the hydraulic helm 36 via the line 82.

It will be appreciated that when the steering wheel 37 is turned to make a right turn and power steering mode is activated, the pump 116 is operating, the pump valve 130 is in the pump on position, the pump 216 is not operating, the pump valve 230 is in the pump off position, and hydraulic fluid will follow generally the same path in reverse. From the mode selection valve 132, hydraulic fluid flows through the pump 116 before flowing to the pump valve 130, and from the pump valve 230, hydraulic fluid flows to the mode selection valve 232 bypassing the pump 216.

Figure 13:
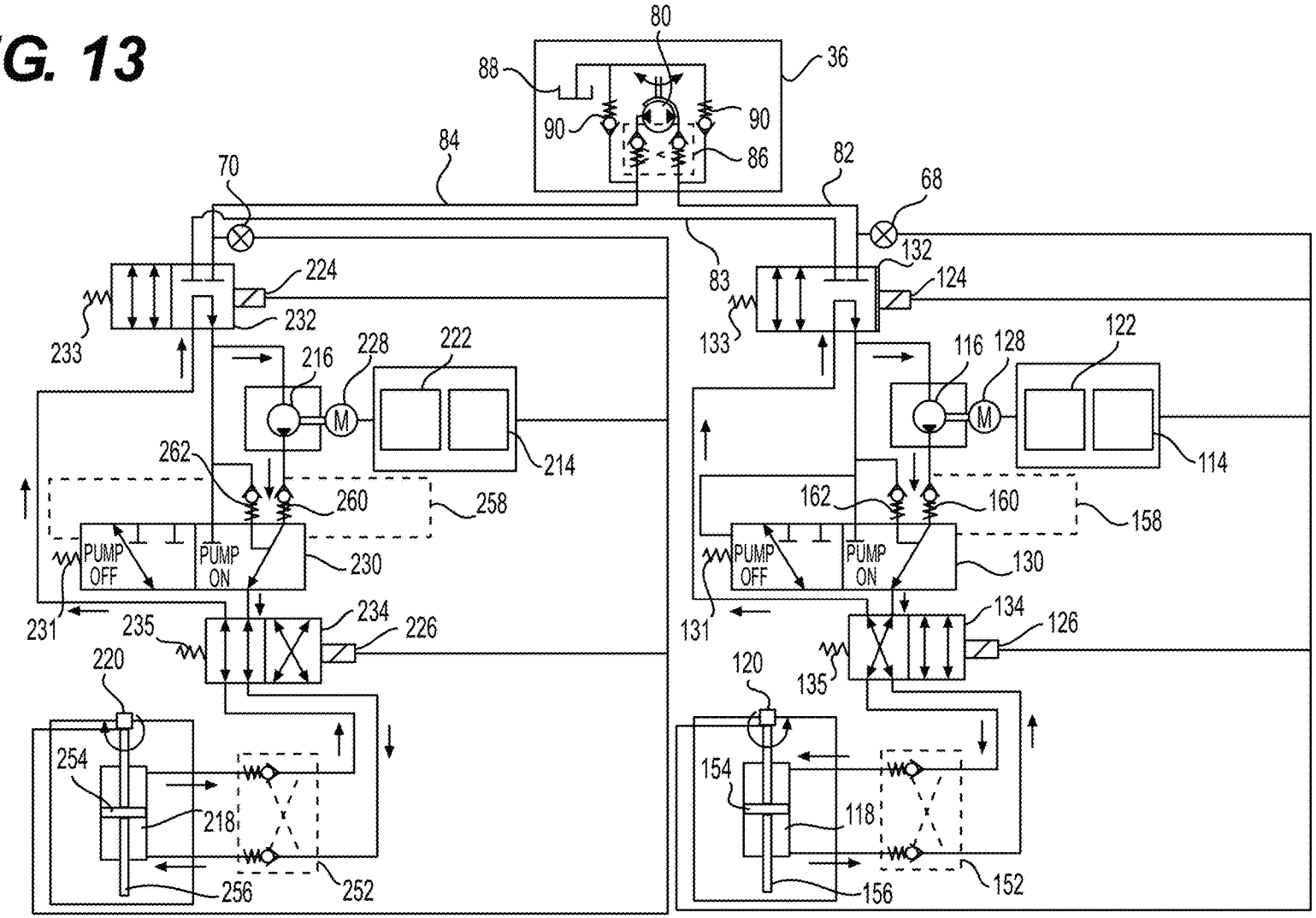
FIG. 13 is a schematic view of the hydraulic steering system of the watercraft of FIG. 1 in a docking mode.

With reference to FIG. 13, the operation of the hydraulic steering system to steer both outboard engines 100, 200 to direct their thrust axes toward the centerline of the watercraft 10, such as in the example illustrated in FIG. 3, 4 or 5, while in the docking mode will be described. In the docking mode, the mode selection valve actuators 124, 224 move the mode selection valves 132, 232 to their docking mode positions illustrated in FIG. 13 in response to the operator activating docking mode via the mode selector 74. When the valves 132, 232 are in their docking mode positions the hydraulic helm 36 is hydraulically disconnected from the hydraulic steering actuators 118, 218 such that the hydraulic helm 36 has no effect on the steering of the watercraft 10. In the example shown in FIG. 13, the hydraulic helm 36 is locked in place when the docking mode is activated. As discussed above, the joystick 38 is the steering input of the watercraft 10 while in the docking mode. As a result of the mode selection valves 132, 232 being in their docking mode positions, the hydraulic steering actuators 118, 218 are hydraulically disconnected from each other. Putting the mode selection valves 132, 232 in their docking mode positions creates a closed starboard hydraulic circuit, including the pump 116 and the hydraulic steering actuator 118, in the starboard outboard engine 100 and a closed port hydraulic circuit, including the pump 216 and the hydraulic steering actuator 218, in the port outboard engine 200. These two closed hydraulic circuits are separate from each other.

In the docking mode, the hydraulic pressure is supplied to the hydraulic steering actuators 118, 218 by the pumps 116, 216 respectively. Since the pumps 116, 216 are unidirectional pumps, in the docking mode, the direction in which the outboard engines 100, 200 are steered is determined by the position of the direction valves 134, 234. The direction valve actuators 126, 226 move the direction valves 134, 234 to the position determined by the steering controllers 114, 214. As such, the two outboard engines 100, 200 can be steered independently from each other and can be steered in opposite directions as is the case in the example of FIG. 13. In order to obtain the steering motion of the outboard engines 100, 200 described above, the direction valve actuators 126, 226 move the direction valves 134, 234 to the positions illustrated in FIG. 13.

In the example of FIG. 13, in response to movement of the joystick 38, the steering controller 114 sends a signal to the motor drive 122 to turn on the motor 128 to operate the pump 116 and the steering controller 214 sends a signal to the motor drive 222 to turn on the motor 228 to operate the pump 216. When the pumps 116, 216 start to operate, the pump valves 130, 230 are moved to their pump on positions in the same manner as described above with reference to FIG. 12 with respect to the pump valve 230 while in the power steering mode.

As a result of the operation of the pumps 116, 216 and the above arrangement of the valves 130, 132, 134, 230, 232, 234, in the docking mode, the pump 116 supplies hydraulic pressure to the steering actuator 118 and the pump 216 supplies hydraulic pressure to the steering actuator 218 such that the outboard engines 100, 200 are steered in opposite directions in order to direct their thrust axes toward the centerline of the watercraft 10, such as in the example illustrated in FIG. 3, 4 or 5.

More specifically, as indicated by the by arrows next to the lines connecting the various components, from the pump 116 hydraulic fluid flows toward the pump valve 130. From the pump valve 130, hydraulic fluid then flows toward the direction valve 134. From the direction valve 134, hydraulic fluid flows toward the hydraulic steering actuator 118. Hydraulic fluid enters the hydraulic steering actuator 118 above the piston 154, causing the piston 154 to move down and turn the shaft 156, thereby steering the starboard outboard engine 100 to direct its thrust axis toward the centerline of the watercraft 10. As the piston 154 moves down, hydraulic fluid below the piston 154 is pushed out of the hydraulic steering actuator 118. From the hydraulic steering actuator 118, hydraulic fluid flows toward the direction valve 134 and then from the direction valve 134 toward the pump 116 via the mode selection valve 132.

Similarly, from the pump 216 hydraulic fluid flows toward the pump valve 230. From the pump valve 230, hydraulic fluid then flows toward the direction valve 234. From the direction valve 234, hydraulic fluid flows toward the hydraulic steering actuator 218. Hydraulic fluid enters the hydraulic steering actuator 218 below the piston 254, causing the piston 254 to move up and turn the shaft 256, thereby steering the port outboard engine 200 in the direction opposite to the steering direction of the outboard engine 100. As the piston 254 moves up, hydraulic fluid above the piston 254 is pushed out of the hydraulic steering actuator 218. From the hydraulic steering actuator 218, hydraulic fluid flows toward the direction valve 234 and then from the direction valve 234 toward the pump 216 via the mode selection valve 232.

Figure 14:
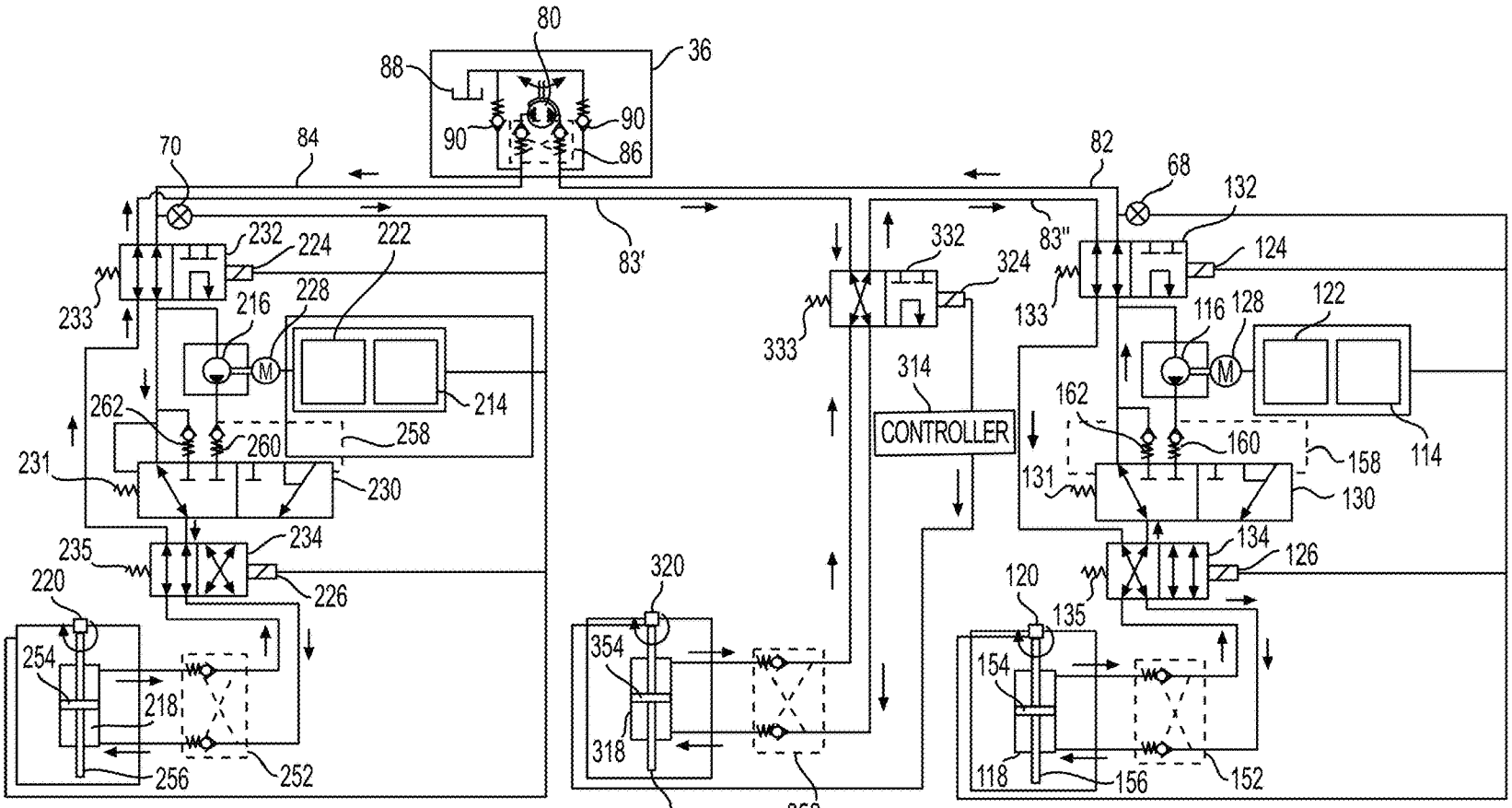
FIG. 14 is a schematic view of a hydraulic steering system of the watercraft of FIG. 1 having three outboard engines in a helm steering mode.

Turning now to FIG. 14, the operation of an alternative implementation of the hydraulic steering system to make a left turn while in the helm steering mode for a watercraft having three outboard engines 100, 200, 300 will be described. The outboard engine 300 has a steering controller 314, a mode selection valve 332 controlled by a mode selection valve actuator 324 and biased by a spring 333, a locking valve 352, a hydraulic steering actuator 318 having a piston 354 and a shaft 356, and a steering actuator position sensor 320. In the present implementation, the outboard engine 300 is not provided with a pump, a pump valve and a direction valve, but it is contemplated that these components could be provided.

In the helm steering mode, the mode selection valve actuators 124, 224, 324 move the mode selection valves 132, 232, 332 to their helm steering mode positions illustrated in FIG. 14. When the valves 132, 232, 332 are in their helm steering mode positions, the hydraulic helm 36 is hydraulically connected to the hydraulic steering actuators 118, 218, 318 such that the hydraulic helm 36 is the steering input of the watercraft 10. The hydraulic steering actuators 118, 218, 318 are also hydraulically connected with each other. Similarly, in the helm steering mode, the direction valve actuators 126, 226 move the direction valves 134, 234 to their helm steering mode positions illustrated in FIG. 14.

In the example of FIG. 14, the difference in hydraulic pressure in the lines 82, 84 as sensed by the helm pressure sensors 68, 70 is below a predetermined threshold and no steering assistance from the pumps 116, 216 is required. Since no steering assistance from the pumps 116, 216 is required, the motors 128, 228 do not operate the pumps 116, 216 and the pump valves 130, 230 are in their pump off positions shown in FIG. 11. Should steering assistance be required, the pumps 116, 216 and the pump valves 130, 230 would operate as described above with respect to the power steering mode described in FIG. 12.

As a result of the above arrangement of the valves 130, 132, 134, 230, 232, 234, 332 when the steering wheel 37 is turned to make a left turn, the hydraulic helm 36 supplies hydraulic pressure to the steering actuator 218, the steering actuator 218 supplies hydraulically pressure to the steering actuator 318 and the steering actuator 318 supplies hydraulically pressure to the steering actuator 118 such that all three outboard engines 100, 200, 300 are steered by the same amount in the same direction in order to make a left turn.

More specifically, as indicated by the by arrows next to the lines connecting the various components, from the hydraulic helm 36 hydraulic fluid flows toward the mode selection valve 232 via the line 84. From the mode selection valve 232, hydraulic fluid flows toward the pump valve 230, then from the pump valve 230 toward the direction valve 234. From the direction valve 234, hydraulic fluid flows toward the hydraulic steering actuator 218. Hydraulic fluid enters the hydraulic steering actuator 218 below the piston 254 of the hydraulic steering actuator 218, causing the piston 254 to move up and turn a shaft 256 of the hydraulic steering actuator 218, thereby steering the port outboard engine 200 to make a left turn. As the piston 254 moves up, hydraulic fluid above the piston 254 is pushed out of the hydraulic steering actuator 218. From the hydraulic steering actuator 218, hydraulic fluid flows toward the direction valve 234 and then from the direction valve 234 toward the mode selection valve 232.

From the mode selection valve 232, hydraulic fluid flows toward the mode selection valve 332 via the line (hydraulic tie bar) 83'. From the mode selection valve 332, hydraulic fluid flows toward the hydraulic steering actuator 318. Hydraulic fluid enters the hydraulic steering actuator 318 below the piston 354 of the hydraulic steering actuator 318, causing the piston 354 to move up and turn the shaft 356 of the hydraulic steering actuator 318, thereby steering the central outboard engine 300 to make a left turn. As the piston 354 moves up, hydraulic fluid above the piston 354 is pushed out of the hydraulic steering actuator 318. From the hydraulic steering actuator 318, hydraulic fluid flows toward the mode selection valve 332.

From the mode selection valve 332, hydraulic fluid flows toward the mode selection valve 132 via the line (hydraulic tie bar) 83". From the mode selection valve 132, hydraulic fluid flows toward the direction valve 134. From the direction valve 134, hydraulic fluid flows toward the hydraulic steering actuator 118. Hydraulic fluid enters the hydraulic steering actuator 118 below a piston 154 of the hydraulic steering actuator 118, causing the piston 154 to move up and turn a shaft 156 of the hydraulic steering actuator 118, thereby steering the starboard outboard engine 100 to make a left turn. As the piston 154 moves up, hydraulic fluid above the piston 154 is pushed out of the hydraulic steering actuator 118. From the hydraulic steering actuator 118, hydraulic fluid flows toward the direction valve 134 and then toward the pump valve 130. From the pump valve 130, hydraulic fluid flows toward the mode selection valve 132. Finally, from the mode selection valve 132, hydraulic fluid flows toward the hydraulic helm 36 via the line 82. It will be appreciated that when the steering wheel 37 is turned to make a right turn, hydraulic fluid will follow the same path in reverse.

For the implementation of the hydraulic fluid system illustrated in FIG. 14, in the docking mode, the mode selection valve actuators 124, 224, 334 move the mode selection valves 132, 232, 332 to their docking mode positions. When the valves 132, 232, 332 are in their docking mode positions the hydraulic helm 36 is hydraulically disconnected from the hydraulic steering actuators 118, 218, 318 such that the hydraulic helm 36 has no effect on the steering of the watercraft 10. The joystick 38 is the steering input of the watercraft 10 while in the docking mode. As a result of the mode selection valves 132, 232, 332 being in their docking mode positions, the hydraulic steering actuators 118, 218, 318 are hydraulically disconnected from each other.

In the docking mode, the outboard engines 100, 200 are steering using the pumps 116, 216 and direction valves 134, 234 to actuate the hydraulic steering actuator 118, 218 in the same manners as described above with reference to the docking mode illustrated in FIG. 13. In the docking mode, since outboard engine 300 is not provided with a pump, the hydraulic steering actuator 318 is hydraulically disconnected from all hydraulic pressure supply sources of the hydraulic steering system and therefore, no hydraulic pressure can be supplied to the hydraulic steering actuator 318. As such, in the docking mode the outboard engine 300 is not steered. It is contemplated to provide the hydraulic circuit of FIGS. 11 to 13 with a third outboard engine mechanically connected, via tie bar, to one of the outboard engines 100, 200 such that the third outboard engine is outside the hydraulic circuit but will nonetheless follow whichever of the outboard engines 100, 200 that it is tied to. It is contemplated that by providing the outboard engine 300 with a pump, a direction valve and their associated components, the outboard engine 300 could be steered in the docking mode in a manner similar to the outboard engines 100, 200.

Figure 15:
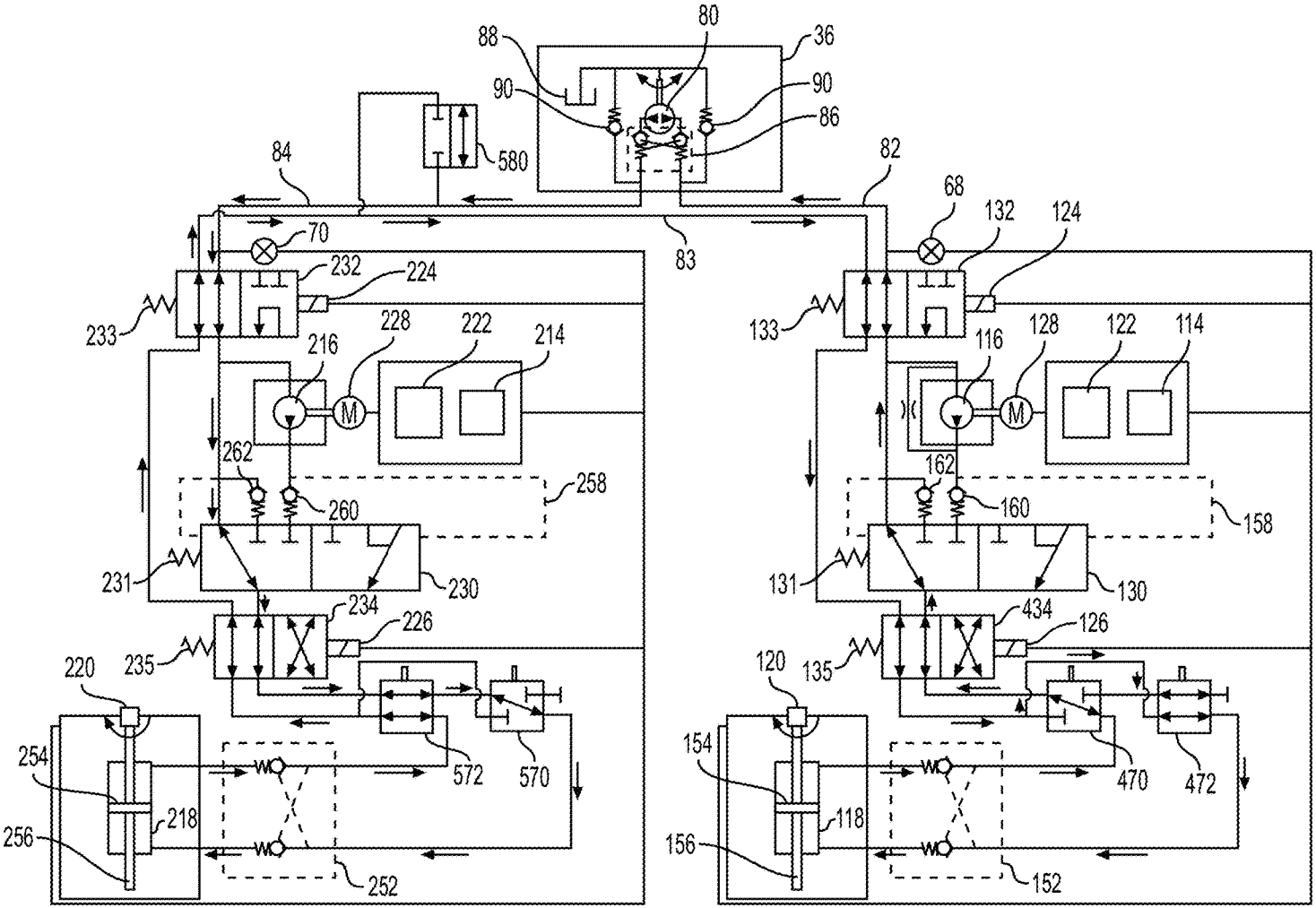
FIG. 15 is a schematic view of an alternative implementation of a hydraulic steering system of the watercraft of FIG. 1 in a helm steering mode with a bypass valve in a closed position.
Figure 16:
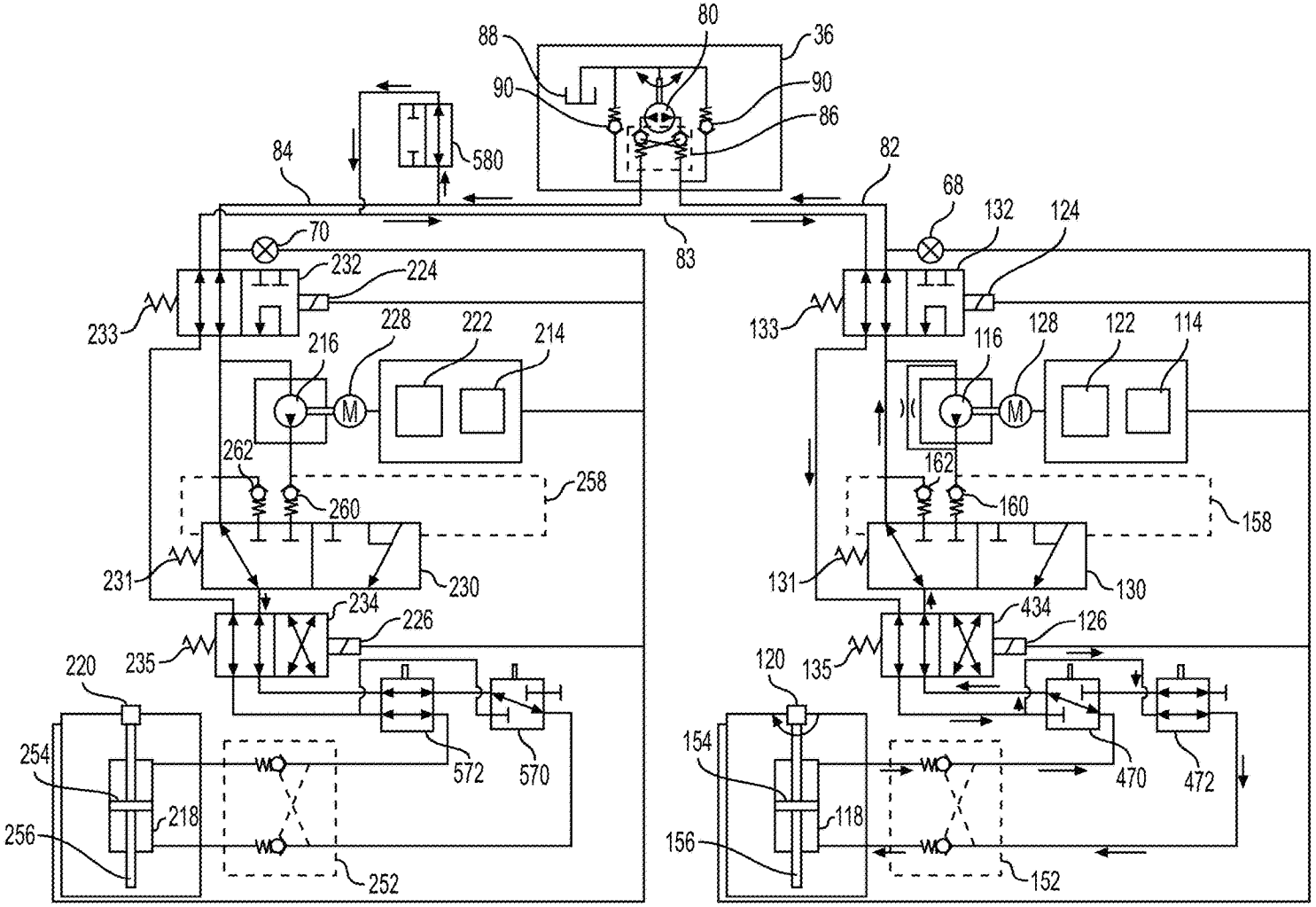
FIG. 16 is a schematic view of the hydraulic steering system of FIG. 15 in the helm steering mode with the bypass valve in an open position.

Turning now to FIGS. 15 and 16, an alternative implementation of a hydraulic steering system of the watercraft 10 will be described in more detail. For simplicity, components of the hydraulic steering system of FIGS. 15 and 16 that correspond to those of the hydraulic steering system illustrated in FIGS. 11 to 13 have been labelled with the same reference numerals and will not be described again in detail.

In the hydraulic steering system illustrated in FIG. 15, the above described direction valve 134 has been replaced with a direction valve 434. As can be seen, the direction valve 434 on the starboard side is identical to the direction valve 234 on the port side. As a result, the two sides of the hydraulic steering system of FIG. 15 have more common parts.

In order to obtain the same flow direction from the direction valve 434 to the rotary actuator 118 as with the direction valve 134 described above, two connectors 470, 472 have been provided between the direction valve 434 and the locking valve 152. The connector 470 is a diverter connector and is connected to the direction valve 434 as shown. The connector 472 is a parallel connector and is connected to the direction valve 434 as shown. It is contemplated that the hydraulic steering system illustrated in FIG. 15 could have the direction valve 134 without the connectors 470, 472 as in the hydraulic steering system shown in FIG. 11.

As can be seen in FIG. 15, two connectors 570, 572 have been provided between the direction valve 234 and the locking valve 252. The connector 570 is a diverter connector and is connected to the direction valve 234 as shown. The connector 572 is a parallel connector and is connected to the direction valve 234 as shown. As can be seen, the connectors 570, 572 are identical to the connectors 470, 472 respectively. As a result, the two sides of the hydraulic steering system of FIG. 15 have more common parts. The order of the connectors 570, 572 between the direction valve 234 and the locking valve 252 is opposite to the order of the connectors 470, 472 between the direction valve 434 and the locking valve 152. It is contemplated that the connectors 570, 572 could be omitted as in the hydraulic steering system shown in FIG. 11.

As can also be seen in FIG. 15, the hydraulic steering system also has a bypass valve 580. As will be explained in greater detail below, the bypass valve 580 allows the two outboard engines 100, 200 to be realigned using the hydraulic helm 36 should they become misaligned relative to each other about their respective steering axes.

The bypass valve 580 is a manual hydraulic valve that can be operated manually by a user of the watercraft 10. In one implementation, the bypass valve 580 is located near the steering wheel 37 such that a user of the watercraft 10 can access the bypass valve 580 and the steering wheel 37 while sitting on the driver seat 28. It is contemplated that the bypass valve 580 could be provided in other locations on the watercraft 10 that can be accessed by a user of the watercraft 10. It is also contemplated that the bypass valve 580 could be actuated by a valve actuator, such as a solenoid, in which case a switch or other input device used to actuate the valve actuator would be provided in a location on the watercraft 10 that can be accessed by a user of the watercraft 10 and the bypass valve 580 itself could be located almost anywhere on the watercraft 10.

The bypass valve 580 is connected between the line 84 connecting the hydraulic helm 36 to the mode selection valve 232 and the line (liquid tie bar) 83 connecting the mode selection valves 132, 232 to each other.

When the bypass valve 580 is closed as shown in FIG. 15, the hydraulic steering system of FIG. 15 operates similarly to the hydraulic steering system of FIGS. 11 to 13. The hydraulic steering system of FIG. 15 can be operated in a helm steering mode, a power steering mode and a docking mode in the same manner as described above with respect to the hydraulic steering system of FIGS. 11 to 13, except that the direction valve 434 is used instead of the direction valve 134. In FIG. 15, the valves 130, 132, 434, 230, 232 and 234 are in their positions corresponding to a helm steering mode.

As a result of the arrangement of the valves 130, 132, 434, 230, 232, 234 in FIG. 15, when the steering wheel 37 is turned to make a left turn and the bypass valve 580 is closed, the hydraulic helm 36 supplies hydraulic pressure to the steering actuator 218, and the steering actuator 218 supplies hydraulic pressure to the steering actuator 118 such that both outboard engines 100, 200 are steered by the same amount in the same direction in order to make a left turn, such as in the example illustrated in FIG. 6.

More specifically, as indicated by the by arrows next to the lines connecting the various components, from the hydraulic helm 36 hydraulic fluid flows toward the mode selection valve 232 via the line 84. From the mode selection valve 232, hydraulic fluid flows toward the pump valve 230, then from the pump valve 230 toward the direction valve 234. From the direction valve 234, hydraulic fluid flows through the connector 572, then through the connector 570, and then toward the hydraulic steering actuator 218. Hydraulic fluid enters the hydraulic steering actuator 218 below the piston 254 of the hydraulic steering actuator 218, causing the piston 254 to move up and turn the shaft 256 of the hydraulic steering actuator 218, thereby steering the port outboard engine 200 to make a left turn. As the piston 254 moves up, hydraulic fluid above the piston 254 is pushed out of the hydraulic steering actuator 218. From the hydraulic steering actuator 218, hydraulic fluid flows through the connector 572, then toward the direction valve 234 and then from the direction valve 234 toward the mode selection valve 232.

From the mode selection valve 232, hydraulic fluid flows toward the mode selection valve 132 via line 83. From the mode selection valve 132, hydraulic fluid flows toward the direction valve 434. From the direction valve 434, hydraulic fluid flows through the connector 472 and then toward the hydraulic steering actuator 118. Hydraulic fluid enters the hydraulic steering actuator 118 below the piston 154 of the hydraulic steering actuator 118, causing the piston 154 to move up and turn a shaft 156 of the hydraulic steering actuator 118, thereby steering the starboard outboard engine 100 to make a left turn. As the piston 154 moves up, hydraulic fluid above the piston 154 is pushed out of the hydraulic steering actuator 118. From the hydraulic steering actuator 118, hydraulic fluid flows through the connector 470, then toward the direction valve 434 and then toward the pump valve 130. From the pump valve 130, hydraulic fluid flows toward the mode selection valve 132. Finally, from the mode selection valve 132, hydraulic fluid flows toward the hydraulic helm 36 via the line 82. It will be appreciated that when the steering wheel 37 is turned to make a right turn, hydraulic fluid will follow the same path in a reverse direction.

When the bypass valve 580 is opened as shown in FIG. 16, hydraulic steering components associated with the port outboard engine 200 are essentially bypassed, but the starboard outboard engine 100 can still be steered using the hydraulic helm. This can be achieved with the valves 130, 132, and 434 in their positions corresponding to a helm steering mode and with the bypass valve 580 in an opened position. As a result, the starboard outboard engine 100 can be steered while the port outboard engine 200 remains stationary, thereby allowing the starboard outboard engine 100 to be realigned with the port outboard engine 200 using the hydraulic helm 36. It is contemplated that the pump 116 could be operated to provide steering assistance of the starboard outboard engine 100 while the bypass valve 580 is opened. When the hydraulic steering system is in the docking mode, the position of the bypass valve 580 has no effect on the steering of the outboard engines 100, 200.

As a result of the arrangement of the valves 130, 132, 434, 230, 232, 234 in FIG. 16, when the steering wheel 37 is turned to make a left turn and the bypass valve 580 is opened, the hydraulic helm 36 supplies hydraulic pressure to the line 84 and, via the bypass valve 580, to the line 83. As a result, the hydraulic pressures acting on the locking valve 252 causes it to remain closed and therefore the steering actuator 218 remains in position such that the outboard engine 200 remains fixed about its steering axis. The hydraulic pressure supplied by the hydraulic helm 36 to the line 83 via the bypass valve 580 is supplied to the steering actuator 118 such that the outboard engine 100 is steered in a direction corresponding to the one normally associate with a left turn.

More specifically, as indicated by the by arrows next to the lines connecting the various components, from the hydraulic helm 36 hydraulic fluid flows toward the bypass valve 580. From the bypass valve 580, hydraulic fluid flows to the line 83. From the line 83, hydraulic fluid flows toward the mode selection valve 132. From the mode selection valve 132, hydraulic fluid flows toward the direction valve 434. From the direction valve 434, hydraulic fluid flows through the connector 472 and then toward the hydraulic steering actuator 118. Hydraulic fluid enters the hydraulic steering actuator 118 below the piston 154 of the hydraulic steering actuator 118, causing the piston 154 to move up and turn a shaft 156 of the hydraulic steering actuator 118, thereby steering the starboard outboard engine 100 in a direction corresponding to the one normally associate with a left turn. As the piston 154 moves up, hydraulic fluid above the piston 154 is pushed out of the hydraulic steering actuator 118. From the hydraulic steering actuator 118, hydraulic fluid flows through the connector 470, then toward the direction valve 434 and then toward the pump valve 130. From the pump valve 130, hydraulic fluid flows toward the mode selection valve 132. Finally, from the mode selection valve 132, hydraulic fluid flows toward the hydraulic helm 36 via the line 82. It will be appreciated that when the steering wheel 37 is turned to make a right turn, hydraulic fluid will follow the same path in a reverse direction.

Once the starboard outboard engine 100 has been realigned with the port engine 200, the bypass valve 530 is closed and normal steering operation can resume via the hydraulic helm 36.

It is contemplated that the bypass valve 580 could alternatively be connected between the line 82 and the line 83 such that the port outboard engine 200 can be steered while the starboard outboard engine 100 remains fixed. It is also contemplated that a bypass valve connected between the line 82 and the line 83 could be provided in addition to the bypass valve 580 illustrated in FIGS. 15 and 16 such that a user of the watercraft 10 can steer either one of the outboard engines 100, 200 individually using the hydraulic helm 36 while the other outboard engine 100 or 200 remains fixed about its steering axis.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A watercraft comprising:

a hull;

a first outdrive operatively connected to the hull;

a first hydraulic steering actuator operatively connected to the first outdrive for steering the first outdrive;

a second outdrive operatively connected to the hull;

a second hydraulic steering actuator operatively connected to the second outdrive for steering the second outdrive;

at least one hydraulic pump selectively supplying hydraulic pressure to at least one of the first and second hydraulic steering actuators;

a steering controller operatively connected to the at least one hydraulic pump for controlling the at least one hydraulic pump;

a hydraulic helm selectively supplying hydraulic pressure to the first and second hydraulic steering actuators;

an auxiliary steering input device connected to the steering controller for sending steering signals to the steering controller; and at least one mode selection valve having a first mode position for steering the watercraft in a first steering mode and a second mode position for steering the watercraft in a second steering mode, in the first steering mode, the at least one mode selection valve is in the first mode position for hydraulically connecting the hydraulic helm to the first and second hydraulic steering actuators, the hydraulic helm is a steering input of the watercraft, and hydraulic pressure is supplied to the first and second hydraulic steering actuators by the hydraulic helm, in the second steering mode, the at least one mode selection valve is in the second mode position for hydraulically disconnecting the hydraulic helm from the first and second hydraulic steering actuators, the auxiliary steering input device is the steering input of the watercraft, and hydraulic pressure is supplied to at least one of the first and second hydraulic steering actuators by the at least one hydraulic pump.

2. The watercraft of claim 1, wherein in the first steering mode the at least one mode selection valve hydraulically connects the first hydraulic steering actuator to the second hydraulic steering actuator such that turning the hydraulic helm in a first direction causes hydraulic pressure to flow from the hydraulic helm to the first hydraulic steering actuator, from the first steering actuator to the second hydraulic actuator, and from the second hydraulic actuator to the hydraulic helm.

3. The watercraft of claim 1, wherein the at least one hydraulic pump is a first hydraulic pump supplying hydraulic pressure to the first hydraulic steering actuator;

the watercraft further comprises a second hydraulic pump supplying hydraulic pressure to the second hydraulic steering actuator;

wherein in the second steering mode the first and second hydraulic steering actuators are hydraulically disconnected from each other, the first hydraulic pump and the first hydraulic steering actuator form a first hydraulic circuit, the second hydraulic pump and the second hydraulic steering actuator form a second hydraulic circuit, and the first and second hydraulic circuits are hydraulically separate from each other.

4. The watercraft of claim 3, wherein in the second steering mode the at least one mode selection valve hydraulically disconnects the first hydraulic steering actuator from the second hydraulic steering actuator.

5. The watercraft of claim 1, further comprising a mode selector connected to the steering controller, the steering controller controlling a position of the at least one mode selection valve in response to signals received from the mode selector.

6. The watercraft of claim 1, wherein the at least one mode selection valve is a first mode selection valve selectively hydraulically connecting the hydraulic helm to the first steering actuator; and the watercraft further comprises a second mode selection valve selectively hydraulically connecting the hydraulic helm to the second steering actuator.

7. The watercraft of claim 1, wherein:

in the first steering mode, the first and second hydraulic steering actuators steer the first and second outdrives together in a same direction; and in the second steering mode, the first and second hydraulic steering actuators steer the first and second outdrives independently from each other.

8. The watercraft of claim 1, further comprising a pump valve selectively hydraulically connecting the at least one hydraulic pump to the at least one of the first and second hydraulic steering actuators, the pump valve hydraulically connecting the at least one hydraulic pump to the at least one of the first and second hydraulic steering actuators at least in the second steering mode.

9. The watercraft of claim 1, further comprising:

a first direction valve hydraulically connected to the first hydraulic steering actuator for controlling a direction of hydraulic pressure supply to the first hydraulic steering actuator; and a second direction valve hydraulically connected to the second hydraulic steering actuator for controlling a direction of hydraulic pressure supply to the second hydraulic steering actuator.

10. The watercraft of claim 9, wherein:

the first and second direction valves are connected to the steering controller;

the steering controller controlling positions of the first and second direction valves;

in the first steering mode, the first and second direction valves remain in a same position regardless of a direction of turning of the hydraulic helm; and in the second steering mode, the steering controller controls positions of the first and second direction valves based on a position of the auxiliary steering device.

11. The watercraft of claim 1, further comprising a helm pressure sensor sensing a hydraulic pressure in the hydraulic helm, the helm pressure sensor being connected to the steering controller for sending a signal representative of the hydraulic pressure in the hydraulic helm to the steering controller, the steering controller actuating the at least one hydraulic pump at least when the hydraulic pressure in the hydraulic helm exceeds a predetermined pressure and the at least one mode selection valve is in the first mode position.

12. The watercraft of claim 1, further comprising:

a third outdrive operatively connected to the hull; and a third hydraulic steering actuator operatively connected to the third outdrive for steering the third outdrive;

wherein:

in the first steering mode, the at least one mode selection valve is in the first mode position for hydraulically connecting the hydraulic helm to the third hydraulic steering actuator, and hydraulic pressure is supplied to the third hydraulic steering actuator by the hydraulic helm, in the second steering mode, the at least one mode selection valve is in the second mode position for hydraulically disconnecting the hydraulic helm from the third hydraulic steering actuator.

13. The watercraft of claim 12, wherein in the second steering mode no hydraulic pressure is supplied to the third hydraulic steering actuator.

14. The watercraft of claim 1, further comprising a thrust input device operatively connected to the first and second outdrives;

wherein in the first steering mode, thrust generated by the first and second outdrives is controlled at least in part based on a position of the trust input device; and wherein in the second steering mode, thrust generated by the first and second outdrives is controlled at least in part on a position of the auxiliary steering input device.

15. The watercraft of claim 1, further comprising a bypass valve hydraulically connected between a first line and a second line, the first line hydraulically connecting the hydraulic helm to the first hydraulic steering actuator, the second line hydraulically connecting the first hydraulic steering actuator to the second hydraulic steering actuator, the bypass valve having an opened position and a closed position, in the first steering mode with the bypass valve in the closed position, the hydraulic helm supplies hydraulic pressure to the first and second hydraulic steering actuators to steer the first and second outdrives, and in the first steering mode with the bypass valve in the opened position, the hydraulic helm supplies hydraulic pressure to the second hydraulic steering actuator to steer the second outdrive, hydraulic pressure is not supplied to the first hydraulic steering actuator by the hydraulic helm and the first outdrive is not steerable via the hydraulic helm.

16. The watercraft of claim 15, wherein the second line is a liquid tie bar.

17. A hydraulic steering system for a watercraft having first and second outdrives, the hydraulic steering system comprising:

a first hydraulic steering actuator for steering the first outdrive;

a second hydraulic steering actuator for steering the second outdrive;

at least one hydraulic pump selectively supplying hydraulic pressure to at least one of the first and second hydraulic steering actuators;

a steering controller operatively connected to the at least one hydraulic pump for controlling the at least one hydraulic pump;

a hydraulic helm selectively supplying hydraulic pressure to the first and second hydraulic steering actuators;

an auxiliary steering input device connected to the steering controller for sending steering signals to the steering controller; and at least one mode selection valve having a first mode position for steering the watercraft in a first steering mode and a second mode position for steering the watercraft in a second steering mode, in the first steering mode, the at least one mode selection valve is in the first mode position for hydraulically connecting the hydraulic helm to the first and second hydraulic steering actuators, the hydraulic helm is a steering input of the watercraft, and hydraulic pressure is supplied to the first and second hydraulic steering actuators by the hydraulic helm, in the second steering mode, the at least one mode selection valve is in the second mode position for hydraulically disconnecting the hydraulic helm from the first and second hydraulic steering actuators, the auxiliary steering input device is the steering input of the watercraft, and hydraulic pressure is supplied to at least one of the first and second hydraulic steering actuators by the at least one hydraulic pump.

18. The hydraulic steering system of claim 17, wherein in the first steering mode the at least one mode selection valve hydraulically connects the first hydraulic steering actuator to the second hydraulic steering actuator such that turning the hydraulic helm in a first direction causes hydraulic pressure to flow from the hydraulic helm to the first hydraulic steering actuator, from the first steering actuator to the second hydraulic actuator, and from the second hydraulic actuator to the hydraulic helm.

19. The hydraulic steering system of claim 17, further comprising:

a first direction valve hydraulically connected to the first hydraulic steering actuator for controlling a direction of hydraulic pressure supply to the first hydraulic steering actuator; and a second direction valve hydraulically connected to the second hydraulic steering actuator for controlling a direction of hydraulic pressure supply to the second hydraulic steering actuator.

20. The hydraulic steering system of claim 17, further comprising a helm pressure sensor sensing a hydraulic pressure in the hydraulic helm, the helm pressure sensor being connected to the steering controller for sending a signal representative of the hydraulic pressure in the hydraulic helm to the steering controller, the steering controller actuating the at least one hydraulic pump at least when the hydraulic pressure in the hydraulic helm exceeds a predetermined pressure and the at least one mode selection valve is in the first mode position.

21. The hydraulic steering system of claim 17, further comprising a bypass valve hydraulically connected between a first line and a second line, the first line hydraulically connecting the hydraulic helm to the first hydraulic steering actuator, the second line hydraulically connecting the first hydraulic steering actuator to the second hydraulic steering actuator, the bypass valve having an opened position and a closed position, in the first steering mode with the bypass valve in the closed position, the hydraulic helm supplies hydraulic pressure to the first and second hydraulic steering actuators for steering the first and second outdrives, and in the first steering mode with the bypass valve in the opened position, the hydraulic helm supplies hydraulic pressure to the second hydraulic steering actuator for steering the second outdrive, hydraulic pressure is not supplied to the first hydraulic steering actuator by the hydraulic helm and the first outdrive is not steerable via the hydraulic helm.

22. The hydraulic steering system of claim 21, wherein the second line is a liquid tie bar.

23. A method for steering a watercraft having first and second hydraulically steered outdrives, the method comprising:

selecting one of a first steering mode and a second steering mode;

in response to selecting the first steering mode:

hydraulically connecting first and second hydraulic steering actuators of the first and second outdrives to a hydraulic helm; and steering the first and second outdrives with the hydraulic helm by supplying hydraulic pressure to the first and second hydraulic steering actuators from the hydraulic helm;

in response to selecting the second steering mode:

hydraulically disconnecting first and second hydraulic steering actuators from the hydraulic helm; and steering the first and second outdrives with an auxiliary steering input device by supplying hydraulic pressure to the first and second hydraulic steering actuators from a hydraulic pump.

24. The method of claim 23, wherein the auxiliary steering input device is a joystick;

wherein the method further comprises controlling thrust generated by the first and second outdrives based at least in part on a position of the joystick in response to selecting the second steering mode.

* * * * *